US009855761B2

(12) United States Patent
Suzuki et al.

(10) Patent No.: US 9,855,761 B2
(45) Date of Patent: Jan. 2, 2018

(54) INK TANK UNIT, INK JET PRINTER, AND INK TANK

(71) Applicant: SEIKO EPSON CORPORATION, Tokyo (JP)

(72) Inventors: Hidenao Suzuki, Nagano (JP); Shoma Kudo, Nagano (JP); Naomi Kimura, Nagano (JP); Keigo Iizawa, Nagano (JP); Masayuki Kanazawa, Nagano (JP); Naofumi Mimura, Nagano (JP); Keisuke Akimoto, Nagano (JP); Ryusuke Takakura, Nagano (JP); Soshi Okawa, Nagano (JP); Munehide Kanaya, Nagano (JP); Nobuyuki Nishi, Nagano (JP); Satoshi Kawamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/273,082

(22) Filed: Sep. 22, 2016

(65) Prior Publication Data

US 2017/0008298 A1 Jan. 12, 2017

Related U.S. Application Data

(62) Division of application No. 14/771,376, filed as application No. PCT/JP2014/001024 on Feb. 26, 2014, now Pat. No. 9,487,012.

(30) Foreign Application Priority Data

Mar. 1, 2013 (JP) ..... 2013-040405
Jul. 19, 2013 (JP) ..... 2013-150217

(51) Int. Cl.
*B41J 2/175* (2006.01)
*B41J 29/13* (2006.01)

(52) U.S. Cl.
CPC ..... *B41J 2/17596* (2013.01); *B41J 2/175* (2013.01); *B41J 2/1752* (2013.01);
(Continued)

(58) Field of Classification Search
CPC .... B41J 2/175; B41J 2/17506; B41J 2/17509; B41J 2/17513; B41J 2/1752; B41J 2/17553; B41J 2/17596; B41J 29/17513
See application file for complete search history.

(56) References Cited

U.S. PATENT DOCUMENTS 4,931,814 A 6/1990 Yoshimura
5,721,576 A 2/1998 Barinaga
(Continued)

FOREIGN PATENT DOCUMENTS

CN 2367456 Y 3/2000
JP 09-156120 A 6/1997
(Continued)

OTHER PUBLICATIONS

The Extended European Search Report for the corresponding European Application No. 14757329.9 dated Nov. 28, 2016.

*Primary Examiner* — Anh T. N. Vo
(74) *Attorney, Agent, or Firm* — Global IP Counselors, LLP

(57) ABSTRACT

An ink tank includes a tank main body that is able to contain ink, an ink filling unit that is provided in the tank main body and has an opening which enables the tank main body to be filled with the ink, and a plurality of ribs that are provided around the ink filling unit of the tank main body and protrude from the tank main body. A clearance in which the ink is held due to a capillary force between the ribs is provided between two adjacent ribs among the plurality of ribs.

8 Claims, 25 Drawing Sheets

(52) U.S. Cl.
CPC ..... *B41J 2/17506* (2013.01); *B41J 2/17509* (2013.01); *B41J 2/17513* (2013.01); *B41J 2/17553* (2013.01); *B41J 29/13* (2013.01)

(56) References Cited

U.S. PATENT DOCUMENTS

| | | | | |
|---|---|---|---|---|
| 5,812,156 | A | 9/1998 | Bullock et al. | |
| 5,825,387 | A | 10/1998 | Cowger et al. | |
| 5,841,453 | A | 11/1998 | Sasaki | |
| 5,844,580 | A | 12/1998 | Barinaga et al. | |
| 5,900,896 | A | 5/1999 | Barinaga et al. | |
| 6,053,604 | A | 4/2000 | Sato et al. | |
| 6,130,695 | A | 10/2000 | Childers et al. | |
| 6,158,848 | A | 12/2000 | Liu | |
| 6,168,267 | B1 | 1/2001 | Komplin | |
| 6,322,205 | B1 | 11/2001 | Childers et al. | |
| 6,409,322 | B1 | 6/2002 | Ishitsu et al. | |
| 6,755,500 | B2 | 6/2004 | Hirano et al. | |
| 7,175,264 | B2 * | 2/2007 | Qingguo | B41J 2/17556 347/85 |
| 7,175,266 | B2 * | 2/2007 | Helterline | B41J 2/17513 347/19 |
| 7,377,628 | B2 | 5/2008 | Oikawa et al. | |
| 7,771,033 | B2 | 8/2010 | Stathem | |
| 8,443,853 | B2 * | 5/2013 | Sarnoff | B41J 2/17506 141/330 |
| 9,090,075 | B2 * | 7/2015 | Matsumoto | B41J 2/17506 |
| 2002/0024571 | A1 | 2/2002 | Childers et al. | |
| 2004/0027432 | A1 | 2/2004 | Childers et al. | |
| 2007/0222833 | A1 | 9/2007 | Ishizawa et al. | |
| 2008/0012914 | A1 | 1/2008 | Ishizawa et al. | |
| 2008/0012915 | A1 | 1/2008 | Ishizawa et al. | |
| 2008/0018718 | A1 | 1/2008 | Ishizawa et al. | |
| 2011/0148999 | A1 | 6/2011 | O'Leary et al. | |
| 2011/0285797 | A1 | 11/2011 | Ogura et al. | |
| 2012/0013687 | A1 | 1/2012 | Ishizawa et al. | |
| 2012/0038719 | A1 | 2/2012 | Shimizu et al. | |
| 2012/0050416 | A1 | 3/2012 | Ishizawa et al. | |
| 2012/0125481 | A1 | 5/2012 | Matsumoto et al. | |

FOREIGN PATENT DOCUMENTS

| | | | |
|---|---|---|---|
| JP | 10-071729 | A | 3/1998 |
| JP | 11-348308 | A | 12/1999 |
| JP | 2012-020497 | A | 2/2012 |
| JP | 2012-051131 | A | 3/2012 |
| JP | 2012-106363 | A | 6/2012 |
| JP | 1455512 | S | 11/2012 |
| JP | 1455916 | S | 11/2012 |
| JP | 2013-000949 | S | 1/2013 |
| JP | 2013-046987 | A | 3/2013 |
| JP | 2013-226726 | A | 11/2013 |
| WO | 2007/122793 | A1 | 11/2007 |

* cited by examiner

INK TANK UNIT, INK JET PRINTER, AND INK TANK

CROSS-REFERENCE TO RELATED APPLICATIONS

This application is a divisional application of U.S. patent application Ser. No. 14/771,376 filed on Aug. 28, 2015, which claims priority to Japanese Patent Application No. 2013-040405 filed on Mar. 1, 2013 and Japanese Patent Application No. 2013-150217 filed on Jul. 19, 2013. The entire disclosures of U.S. patent application Ser. No. 14/771,376, Japanese Patent Application No. 2013-040405 and Japanese Patent Application No. 2013-150217 are hereby incorporated herein by reference.

BACKGROUND

Technical Field

The present invention relates to an ink tank unit, an ink jet printer, an ink tank, and the like.

Related Art

In the related art, an ink jet-type printer has been known as an example of a liquid ejecting apparatus. In general, in the ink jet-type printer, ink is ejected onto a printing medium such as paper from a print head and thereby, it is possible to perform printing on the printing medium. In some cases, a printer (printing apparatus) which performs printing using ink may include an ink container which contains ink for supplying to the print head. In the related art, for such a printer, a method of filling ink into the ink container using an ink fill vessel in which new ink is contained has been known (for example, see U.S. Pat. No. 7,771,033).

In a case where ink is filled into the ink container through the ink fill vessel in which the ink is contained, it is considered that ink will spill out from the ink fill vessel or ink will drip down from the ink fill vessel. When ink spills out or drips down form the ink fill vessel, contamination spreads throughout the printer, which further results in deterioration of print quality, as one factor. No method of preventing ink from spilling out is disclosed in U.S. Pat. No. 7,771,033.

SUMMARY

The present invention is provided to solve at least a part of the problems described above and thus can be realized in the following aspect.

According to one aspect of the invention, an ink tank includes a tank main body that is able to contain ink, an ink filling unit that is provided in the tank main body and has an opening which enables the tank main body to be filled with the ink, and two or more (a plurality of) ribs that are provided around the ink filling unit of the tank main body and protrude from the tank main body. Here, a clearance in which the ink is held due to a capillary force between the ribs is provided between two adjacent ribs among the plurality of ribs.

In the ink tank according to the aspect, it is possible to hold the ink spilled out or leaked out from the ink filling unit between two or more ribs. In this manner, it is easy to avoid wide spreading of the ink spilled out or leaked out from the ink filling unit.

DETAILED DESCRIPTION OF EMBODIMENTS

Figure 1:
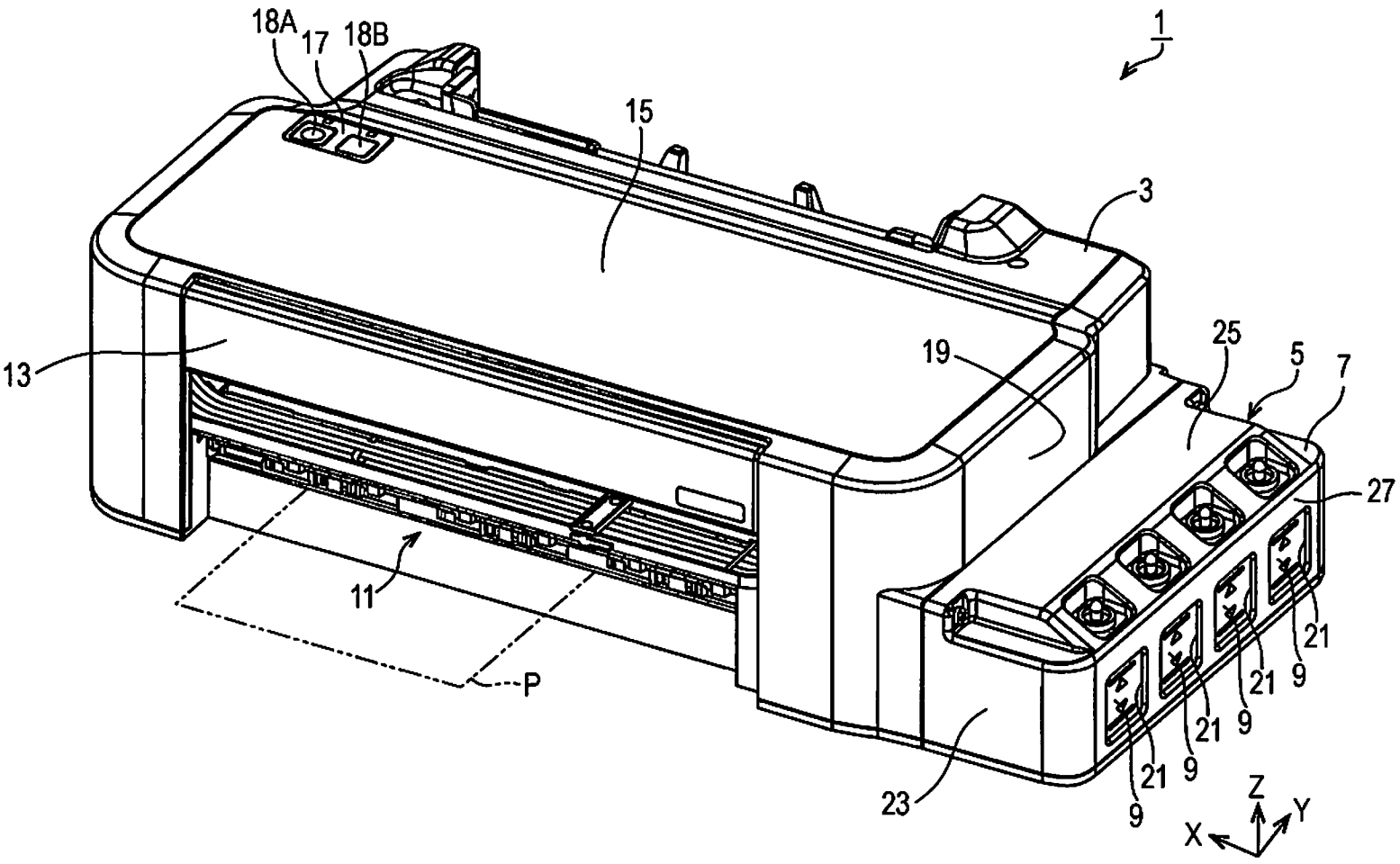
FIG. 1 is a perspective view illustrating a printer according to a first embodiment.

Embodiments will be described with reference to the drawings, with an ink jet printer (hereinafter, referred to as a printer) as an example of a liquid discharge apparatus. In order to show the configurations in a recognizable size, configurations and members may have different scales in the drawings.

First Embodiment

A printer 1 according to a first embodiment can perform printing on a printing medium P such as printing paper with ink as an example of a liquid. As illustrated in FIG. 1, the printer 1 includes a first case 3 and an ink tank unit 5. The ink tank unit 5 includes a second case 7 as an example of a case member and a plurality of (two or more) ink tanks 9. The first case 3 and the second case 7 configure an external frame of the printer 1. In FIG. 1, X, Y, and Z axes are attached as a coordinate system in which the three axes are orthogonal to each other. In the following drawings, the X, Y, and Z axes are attached as necessary. In the X, Y, and Z axes, a direction of an arrow represents a positive direction and a direction opposite to the direction of the arrow represents a negative direction. In a state in which the printer 1 is operated, the printer 1 is disposed on a horizontal plane defined by an X axial direction and a Y axial direction. In the operation state of the printer 1, a Z axial direction means a direction orthogonal to the horizontal plane and a negative Z axial direction means a vertically downward direction.

A mechanism unit 10 (FIG. 3) of the printer 1 is accommodated in the first case 3. The mechanism unit 10 means a mechanism section which performs a printing operation in the printer 1. The mechanism unit 10 will be described below in detail. As illustrated in FIG. 1, the plurality of ink tanks 9 are accommodated in the second case 7 and contain ink used in printing, respectively. In the present embodiment, four ink tanks 9 are provided. A type of ink is different for each ink tank 9 of the four ink tanks 9. In the present embodiment, four types of ink of black, yellow, magenta, and cyan are employed as types of ink. An ink tank 9 is provided to contain black ink, another ink tank 9 is provided to contain yellow ink, still another ink tank 9 is provided to contain magenta ink, and still another ink tank 9 is provided to contain cyan ink.

In addition, a discharge unit 11 is provided in the printer 1. The printing medium P is discharged from the discharge unit 11 in the printer 1. A surface on which the discharge unit 11 is provided corresponds to a front surface 13 in the printer 1. In addition, the printer 1 has an operational panel 17 on a top surface 15 intersecting with the front surface 13. A power button 18A, another operation button 18B, or the like, is provided on the operational panel 17. The ink tank unit 5 is provided on a side section 19 intersecting with the front surface 13 and the top surface 15 on the first case 3. Window sections 21 are provided on the second case 7. The window section 21 is provided on a side section 27 intersecting with a front surface 23 and a top surface 25 on the second case 7. The window section 21 is optically transparent. The four ink tanks 9 described above are provided at positions which overlap with the window sections 21. Thus, an operator who uses the printer 1 can visually recognize the four ink tanks 9 through the window sections 21.

Figure 2:
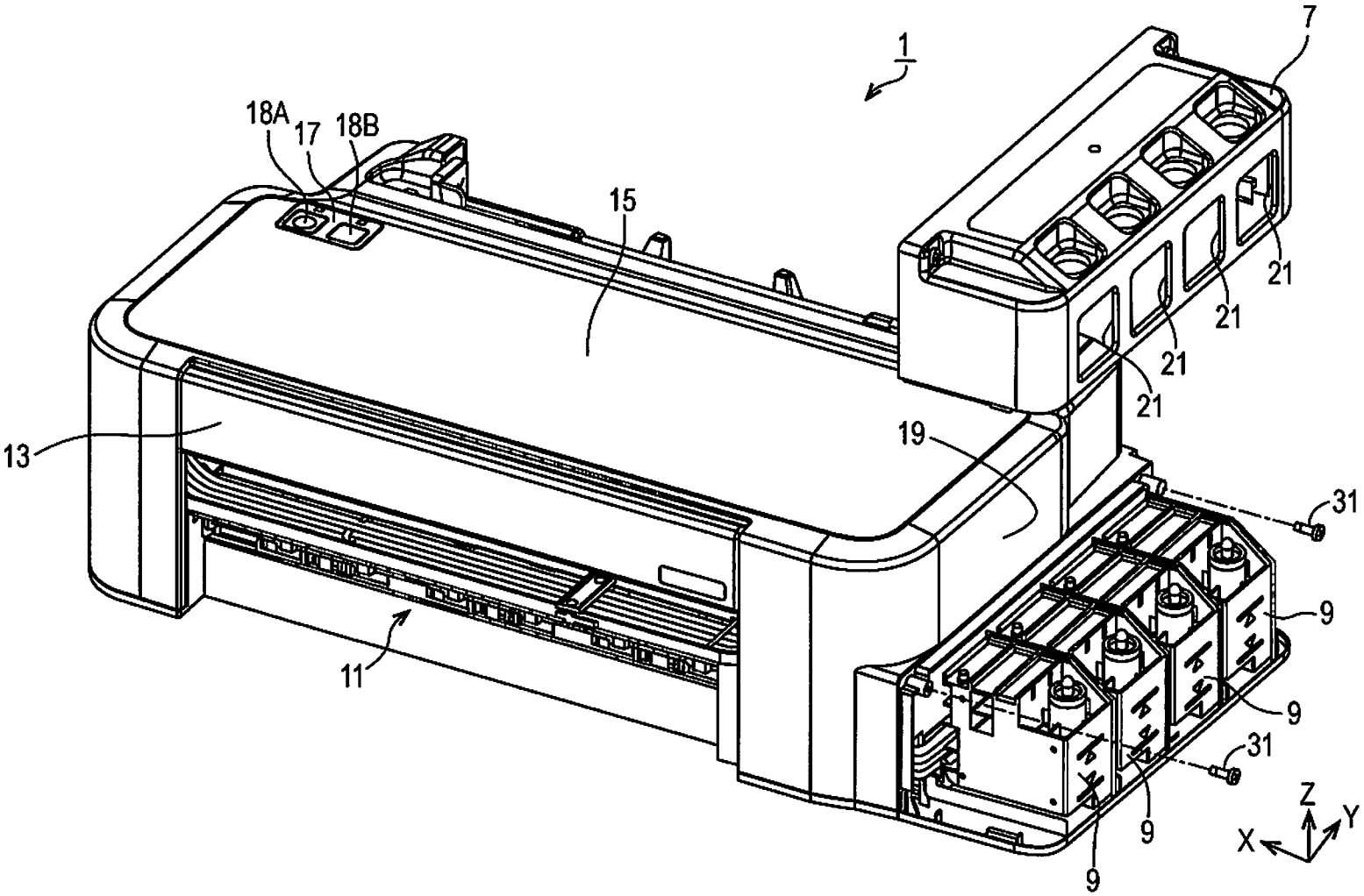
FIG. 2 is a perspective view illustrating the printer according to the first embodiment.

In the present embodiment, a portion of the ink tank 9, which faces the window section 21, is optically transparent. Ink in the ink tank 9 can be visually recognized through the portion of the ink tank 9, which is optically transparent. Therefore, the operator visually recognizes the four ink tanks 9 through the window sections 21 and thereby, it is possible to visually recognize an amount of ink in the ink tank 9. The first case 3 and the second case 7 are configured as separate bodies from each other. Thus, in the present embodiment, as illustrated in FIG. 2, it is possible to separate the second case 7 from the first case 3. The second case 7 is joined to the first case 3 using a mounting screw 31. In addition, as illustrated in FIG. 2, the second case 7 covers at least a part of, for example, the front surface, top surface, and side surfaces of the four (two or more) ink tanks 9.

Figure 3:
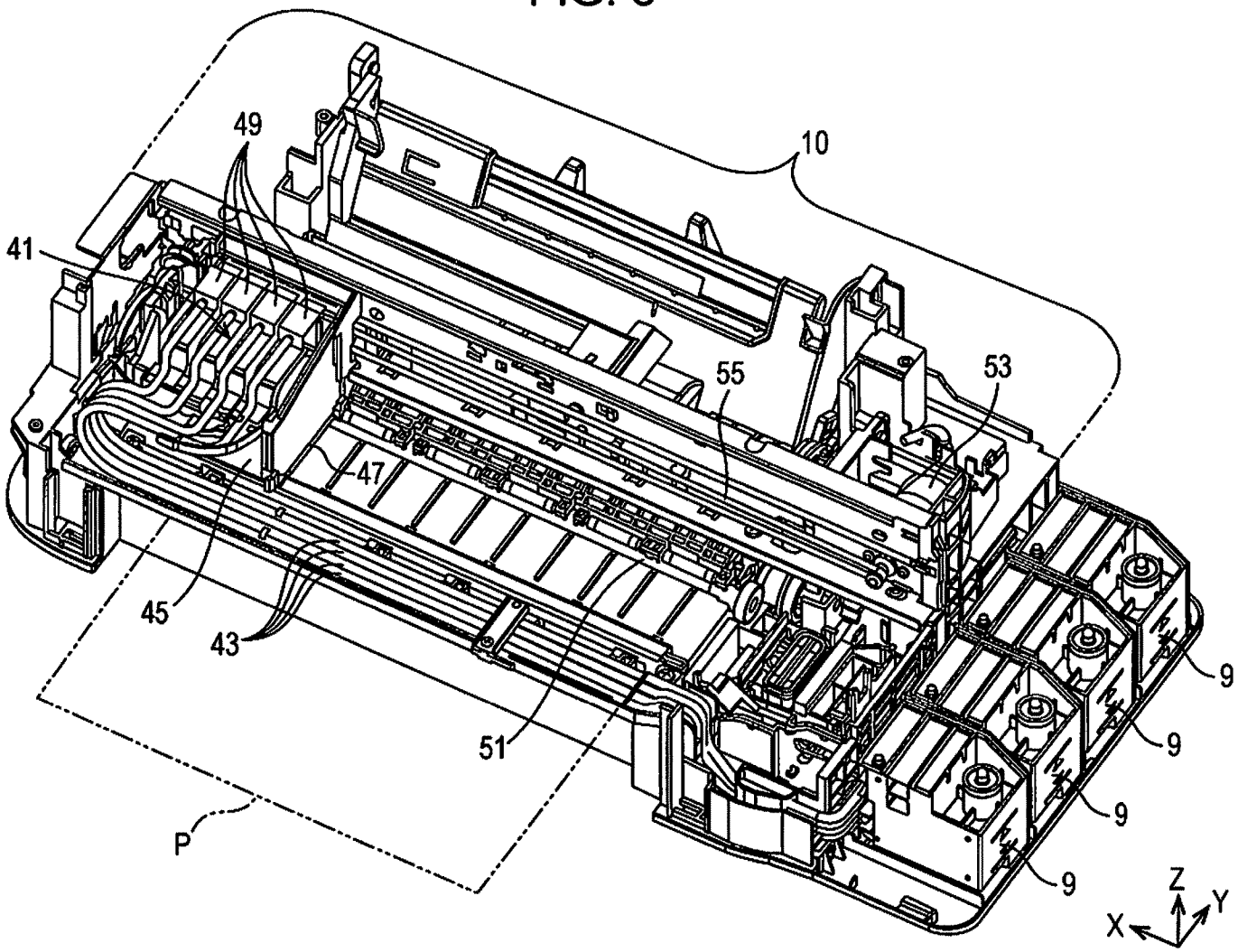
FIG. 3 is a perspective view illustrating a mechanism unit of the printer according to the first embodiment.

As illustrated in FIG. 3 showing a perspective view of the mechanism unit 10, the printer 1 includes a printing unit 41 and a supply tube 43. The printing unit 41 includes a carriage 45, a print head 47, and four relay units 49. The print head 47 and the four relay units 49 are mounted in the carriage 45. The supply tube 43 is flexible and is provided between the ink tank 9 and the relay unit 49. Ink in the ink tank 9 is sent to the relay unit 49 through the supply tube 43. The relay unit 49 relays ink supplied from the ink tank 9 through the supply tube 43 to the print head 47. The print head 47 discharges the supplied ink as ink droplets.

In addition, the printer 1 includes a medium transport mechanism (not illustrated) and a head transport mechanism (not illustrated). The medium transport mechanism drives a transport roller 51 with power from a motor (not illustrated) and thereby transports the printing medium P in the Y axial direction. The head transport mechanism transmits power from a motor 53 to the carriage 45 through a timing belt 55 and thereby transports the carriage 45 in the X axial direction. The print head 47 is mounted in the carriage 45. Thus, the print head 47 can be transported in the X axial direction on contact with the carriage 45 by the head transport mechanism. The print head 47 is supported by the carriage 45 in a state of facing the printing medium P. While the medium transport mechanism and the head transport mechanism cause a position of the print head 47 relative to the printing medium P to be changed, ink is discharged from the print head 47 and thereby, printing is performed on the printing medium P.

Figure 4:
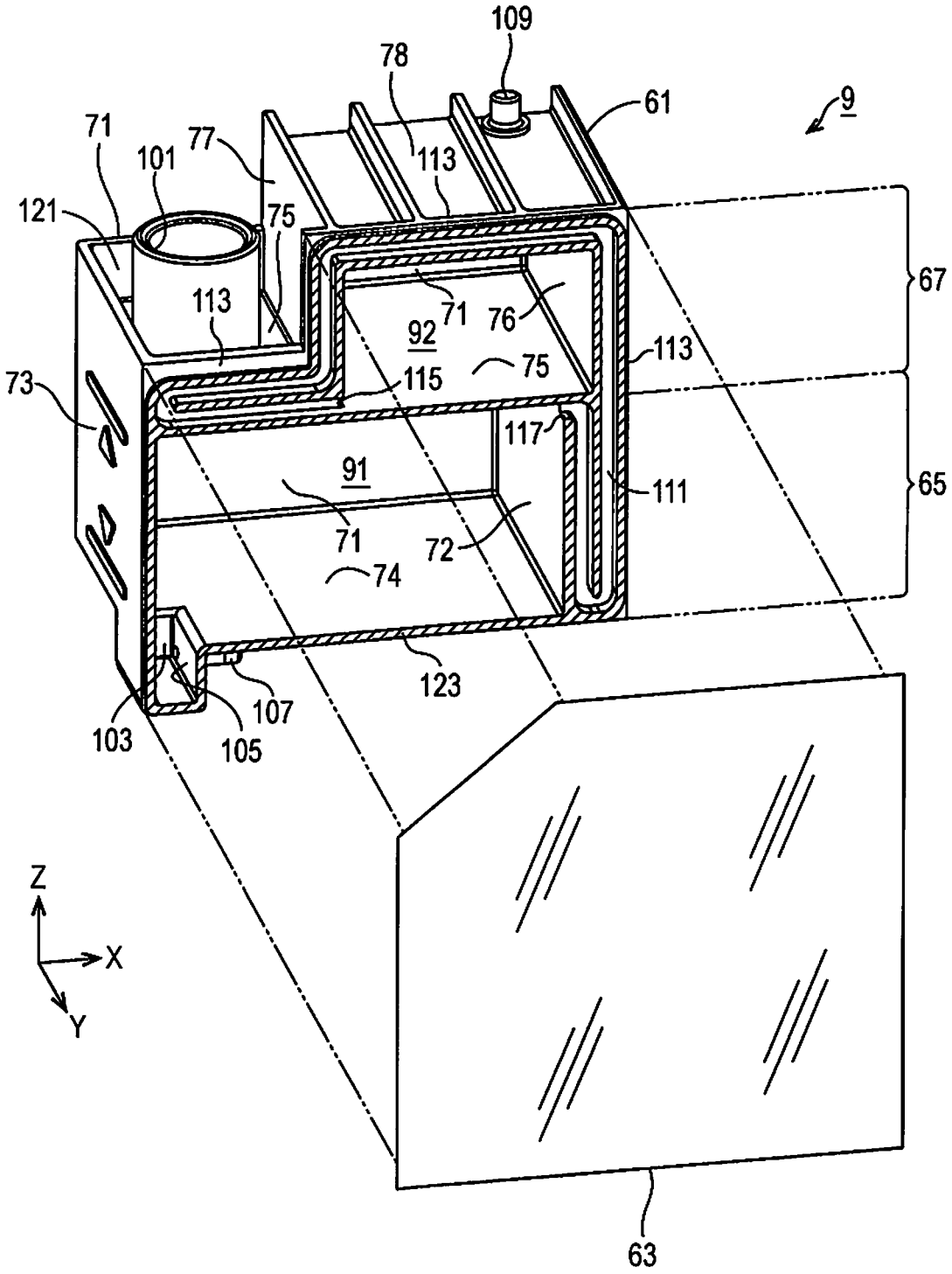
FIG. 4 is an exploded perspective view illustrating an ink tank according to the first embodiment.

As illustrated in FIG. 4, the ink tank 9 includes a case 61 as an example of a tank main body and a sheet member 63. The case 61, for example, is configured of a synthetic resin such as nylon or polypropylene. In addition, the sheet member 63 is formed into a film shape by the synthetic resin (for example, nylon or polypropylene) and thus is flexible. In the present embodiment, the sheet member 63 is optically transparent. The case 61 has a container unit 65 and an air chamber 67.

The container unit 65 has a first wall 71, a second wall 72, a third wall 73, a fourth wall 74, and a fifth wall 75. The air chamber 67 has the first wall 71, the fifth wall 75, a sixth wall 76, a seventh wall 77, and an eighth wall 78. The second wall 72, the third wall 73, the fourth wall 74, and the fifth wall 75 of the container unit 65 intersect with the first wall 71. The second wall 72 and the third wall 73 are provided at positions facing each other, with the first wall 71 interposed therebetween in the X axial direction. The fourth wall 74 and the fifth wall 75 are provided at positions facing each other, with the first wall 71 interposed therebetween in the Z axial direction. The second wall 72 intersects with each of the fourth wall 74 and the fifth wall 75. The third wall 73 also intersects with each of the fourth wall 74 and the fifth wall 75.

The first wall 71 is surrounded by the second wall 72, the third wall 73, the fourth wall 74, and the fifth wall 75 in a plan view. The second wall 72, the third wall 73, the fourth wall 74, and the fifth wall 75 protrude from the first wall 71 in the +Y axial direction. Thus, the container unit 65 is configured to have a recessed shape with the first wall 71 as the main wall, and by the second wall 72, the third wall 73, the fourth wall 74, and the fifth wall 75 which extend perpendicularly from the main wall. A recessed section 91 is configured of the first wall 71, the second wall 72, the third wall 73, the fourth wall 74, and the fifth wall 75. The recessed section 91 is configured to be recessed toward the −Y axial direction. The recessed section 91 is opened toward the +Y axial direction, that is, toward the sheet member 63. Ink is contained in the recessed section 91. The first wall 71, the second wall 72, the third wall 73, the fourth wall 74, and the fifth wall 75 are all not limited to a flat surface, but may have an uneven surface.

The air chamber 67 is provided on the fifth wall 75. The air chamber 67 protrudes from the fifth wall 75 toward the side of the fifth wall 75 opposite to the fourth wall 74, that is, toward the +Z axial direction side of the fifth wall 75. The first wall 71 of the container unit 65 is the same wall as the first wall 71 of the air chamber 67. In other words, in the present embodiment, the container unit 65 and the air chamber 67 share the first wall 71 with each other.

The sixth wall 76 protrudes from the fifth wall 75 toward the side of the fifth wall 75 opposite to the fourth wall 74, that is, toward the +Z axial direction side of the fifth wall 75. The seventh wall 77 protrudes from the fifth wall 75 toward the side of the fifth wall 75 opposite to the fourth wall 74, that is, toward the +Z axial direction side of the fifth wall 75. The sixth wall 76 and the seventh wall 77 are provided at positions facing each other, with the first wall 71 of the air chamber 67 interposed therebetween in the X axial direction. The eighth wall 78 is provided at position facing the fifth wall 75, with the first wall 71 of the air chamber 67 interposed therebetween in the Z axial direction. The sixth wall 76 intersects with each of the fifth wall 75 and the eighth wall 78. The seventh wall 77 also intersects with each of the fifth wall 75 and the eighth wall 78.

The first wall 71 of the air chamber 67 is surrounded by the fifth wall 75, the sixth wall 76, the seventh wall 77, and the eighth wall 78 in a plan view. The fifth wall 75, the sixth wall 76, the seventh wall 77, and the eighth wall 78 protrude from the first wall 71 in the +Y axial direction. Thus, the air chamber 67 is configured to have a recessed shape with the first wall 71 as the main wall, and by the fifth wall 75, the sixth wall 76, the seventh wall 77, and the eighth wall 78 which extend perpendicularly from the main wall. A recessed section 92 of the air chamber 67 is configured of the first wall 71, the fifth wall 75, the sixth wall 76, the seventh wall 77, and the eighth wall 78. The recessed section 92 is configured to be recessed toward the −Y axial direction. The recessed section 92 is opened toward the +Y axial direction, that is, toward the sheet member 63. The recessed section 91 and the recessed section 92 are partitioned from each other with the fifth wall 75 as a partition wall. Protrusion amounts of the second wall 72 to the eighth wall 78 from the first wall 71 are set to be the same as each other.

The second wall 72 and the sixth wall 76 are formed to have a step in the X axial direction therebetween. The second wall 72 is positioned on the third wall 73 side from the sixth wall 76, that is, on the −X axial direction side from the sixth wall 76. In addition, the third wall 73 and the seventh wall 77 are formed to have a step in the X axial direction therebetween. The seventh wall 77 is positioned on the second wall 72 side from the third wall 73, that is, on the +X axial direction side from the third wall 73. In a state of viewing the first wall 71 in a plan view, the ink filling unit 101 is provided between the third wall 73 and the seventh wall 77. The ink filling unit 101 is provided on the fifth wall 75.

Here, a recessed section 103 is provided in the recessed section 91. The recessed section 103 is provided toward the side opposite to the fifth wall 75 side from the fourth wall 74, that is, toward the −Z axial direction from the fourth wall 74. A supply port 107 is provided on the wall 105 of the recessed section 103, which faces the third wall 73 and the second wall 72. Thus, in the state of viewing the first wall 71 in the plan view, the supply port 107 is provided between the third wall 73 and the second wall 72. Each of the ink filling unit 101 and the supply port 107 causes the outside of the case 61 to communicate with the inner side of the recessed section 91. The supply port 107 protrudes in the X axial direction from the wall 105 toward the second wall 72 side.

In addition, an air vent 109 is provided on the eighth wall 78. The air vent 109 protrudes from the eighth wall 78 to the side of the eighth wall 78 opposite to the fifth wall 75, that is, to the +Z axial direction of the eighth wall 78. The air vent 109 causes the outer side of the case 61 to communicate with the inner side of the recessed section 92. The air vent 109 is an air passage for guide air on the outer side of the case 61 into the inner side of the recessed section 92.

An air guiding-in path 111 is provided in the case 61 and enables the recessed section 92 and the recessed section 91 to communicate with each other. The air guiding-in path 111 is provided in a projecting section 113. The projecting section 113 has a projecting section along an edge of an opening of the recessed section 91 toward the +Z axial direction side from the fifth wall 75 in a region of the fifth wall 75 on the −X axial direction side from the seventh wall 77. In addition, the projecting section 113 has a projecting section on the seventh wall 77 along an edge of an opening of the recessed section 92 toward the −X axial direction side from the seventh wall 77. In addition, the projecting section 113 has a projecting section on the eighth wall 78 along the edge of the opening of the recessed section 92 toward the +Z axial direction side from the eighth wall 78. In addition, the projecting section 113 has a projecting section on the sixth wall 76 along the edge of the opening of the recessed section 92 toward the +X axial direction side from the sixth wall 76. In addition, the projecting section 113 has a projecting section on the second wall 72 along the edge of the opening of the recessed section 91 toward the +X axial direction side from the second wall 72. As above, the projecting section 113 is provided along the edge of the openings of the recessed section 91 and the recessed section 92.

The air guiding-in path 111 is configured as a groove provided in the projecting section 113 to form a recessed shape toward the side opposite to the sheet member 63. The air guiding-in path 111 has a sending-out port 115 and a guide-in port 117. The sending-out port 115 is an opening that is open toward the inner side of the recessed section 92. The guide-in port 117 is an opening that is open toward the inner side of the recessed section 91. Air on the inner side of the recessed section 92 enters the inside of the air guiding-in path 111 from the sending-out port 115 which is an entrance of the air guiding-in path 111. Air in the air guiding-in path 111 is guided to the recessed section 91 side through the air guiding-in path 111 and is emitted to the inside of the recessed section 91 from the guide-in port 117 which is an outlet of the air guiding-in path 111.

The ink filling unit 101 is provided on the fifth wall 75. The ink filling unit 101 is provided in a recessed section 121 surrounded by the seventh wall 77, the projecting section 113, the third wall 73, and the first wall 71. As described above, the projecting section 113 protrudes from the fifth wall 75 to the eighth wall 78 side. In addition, the seventh wall 77 also protrudes from the fifth wall 75 to the eighth wall 78. Similarly, in the present embodiment, the first wall 71 and the third wall 73 protrude from the fifth wall 75 to the eighth wall 78. The seventh wall 77 intersects with both the projecting section 113 and the third wall 73. In addition, the first wall 71 intersects with both the third wall 73 and the seventh wall 77. Thus, the region of the fifth wall 75 on the third wall 73 side from the seventh wall 77 configures the recessed section 121 surrounded by the seventh wall 77, the projecting section 113, the third wall 73, and the first wall 71. The recessed section 121 is provided to be recessed toward the fourth wall 74 from the fifth wall 75.

In the configuration described above, a peripheral section of the ink filling unit 101 is surrounded by the seventh wall 77, the projecting section 113, the third wall 73, and the first wall 71. In other words, a region of the fifth wall 75, which is surrounded by the seventh wall 77, the projecting section 113, the third wall 73, and the first wall 71 corresponds to the peripheral section of the ink filling unit 101. The recessed section 121 has a function of an ink receiving section. For example, the ink receiving section can receive ink spilled out from the ink filling unit 101 or ink dripped down during filling. Accordingly, the recessed section 121 has a function as the ink receiving section that receives ink.

The sheet member 63 faces the first wall 71 with the second wall 72 to the eighth wall 78 interposed therebetween in the Y axial direction. The sheet member 63 has a size to cover the recessed section 91, the recessed section 92, and the projecting section 113 in a plan view. The sheet member 63 adheres to an adhesion section 123 provided in the case 61. In FIG. 4, in order to show the configuration in an easy understanding way, the adhesion section 123 is hatched. The adhesion section 123 is provided along outlines of the recessed section 91, the recessed section 92, the recessed section 103, and the projecting section 113 in the case 61. The sheet member 63 adheres to the adhesion section 123 in a state in which a clearance is provided between the sheet member 63 and the first wall 71. In this manner, the recessed section 91, the recessed section 92, the recessed section 103, and the air guiding-in path 111 are sealed by the sheet member 63. Thus, it is also considered that the sheet member 63 functions as a lid to the case 61.

Figure 5:
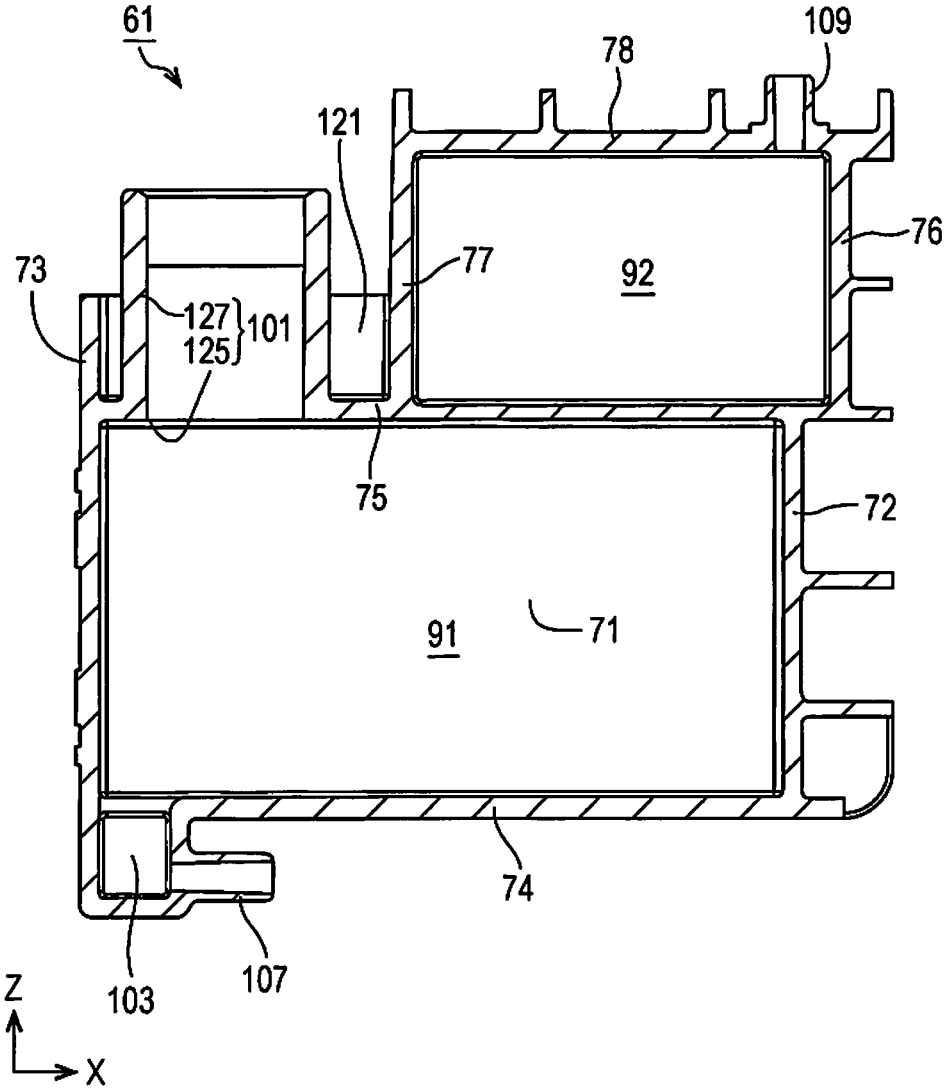
FIG. 5 is a sectional view illustrating a supply port and an air vent cut in an XZ plane in the ink tank according to the first embodiment.

As illustrated in FIG. 5 showing a sectional view of the ink filling unit 101, the supply port 107, and the air vent 109 which are cut in an XZ plane, the ink filling unit 101 includes an opening 125, and a side wall 127. The opening 125 is a through-hole provided in the fifth wall 75. The recessed section 91 communicates with the outside of the recessed section 91 through the opening 125 as the through-hole. The side wall 127 is provided on the side of the fifth wall 75 opposite to the fourth wall 74 and surrounds the periphery of the opening 125. The side wall 127 protrudes from the fifth wall 75 to the side opposite to the fourth wall 74. In the present embodiment, the side wall 127 protrudes from both the first wall 71 and the third wall 73 to the side opposite to the fourth wall 74. The side wall 127 can prevent ink accumulated in the recessed section 121 from flowing into the opening 125.

Figure 6:
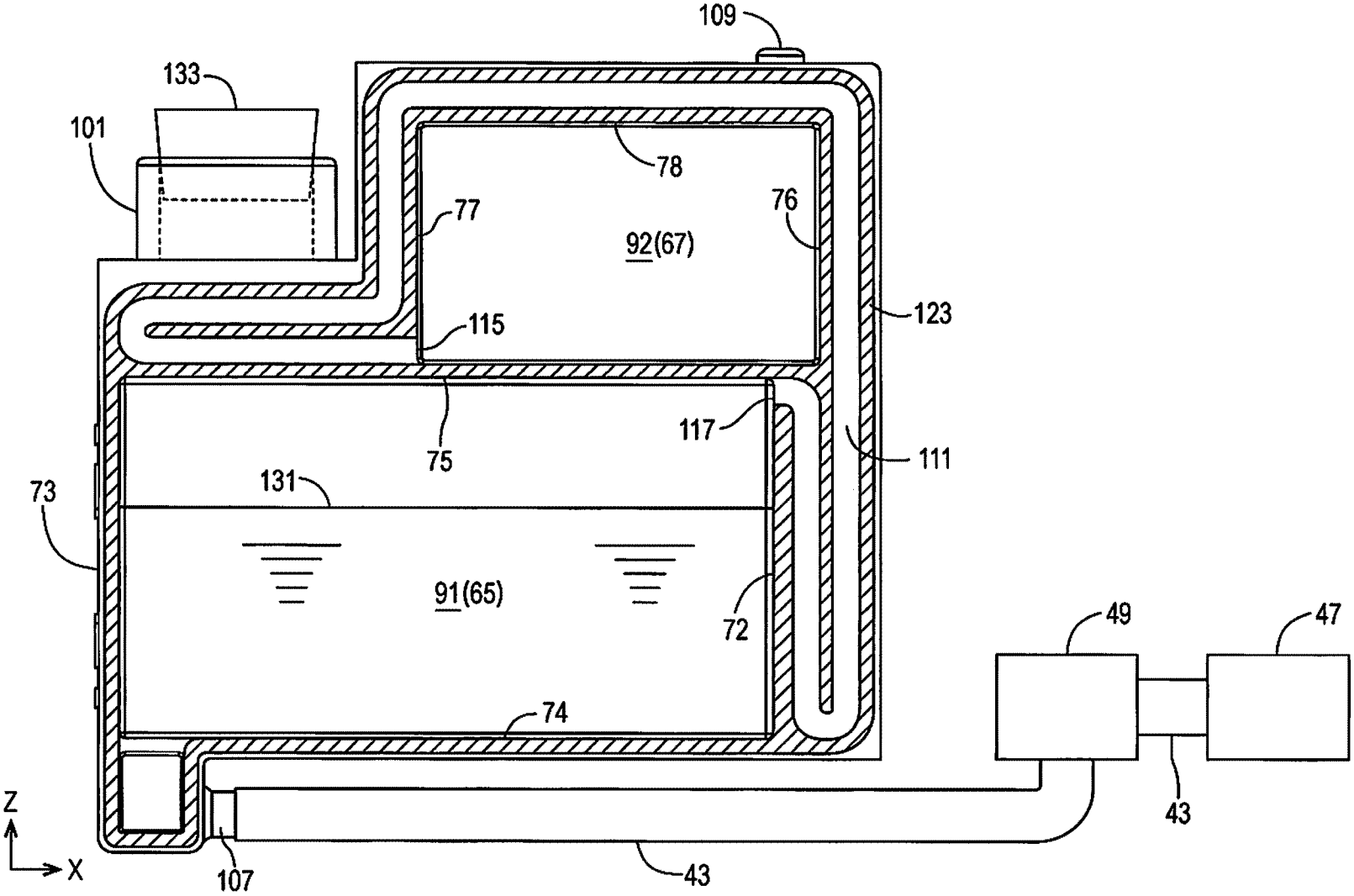
FIG. 6 is a side view illustrating the ink tank according to the first embodiment when viewed from a sheet member side.

As illustrated in FIG. 6 showing a side view of the ink tank 9 when viewed from the sheet member 63 side, ink 131 is contained inside the recessed section 91 in the ink tank 9. In FIG. 6, in order to show the configuration in an easy understanding way, the sheet member 63 is omitted in the drawing and the adhesion section 123 is hatched. The ink 131 in the recessed section 91 is supplied to the print head 47 from the supply port 107. In the present embodiment, in a state in which the printer 1 is used in printing, the supply tube 43 is connected to the supply port 107 and a plug 133 is inserted into the ink filling unit 101. The ink 131 in the recessed section 91 is suctioned into the supply tube 43 through the relay unit 49 and thereby reaches the print head 47 from the supply port 107.

The ink 131 in the recessed section 91 is sent to the print head 47 side along with the printing by the print head 47. Thus, a pressure in the recessed section 91 becomes lower than the atmospheric pressure along with the printing by the print head 47. When the pressure in the recessed section 91 becomes lower than the atmospheric pressure, air in the recessed section 92 is sent to the recessed section 91 through the air guiding-in path 111. In this manner, it is easy to maintain the pressure in the recessed section 91 at the atmospheric pressure. As described above, the ink 131 in the ink tank 9 is supplied to the print head 47. When the ink 131 in the recessed section 91 of the ink tank 9 is consumed and a remaining amount of the ink 131 becomes small, the operator can refill the recessed section 91 with new ink from the ink filling unit 101.

Figure 7:
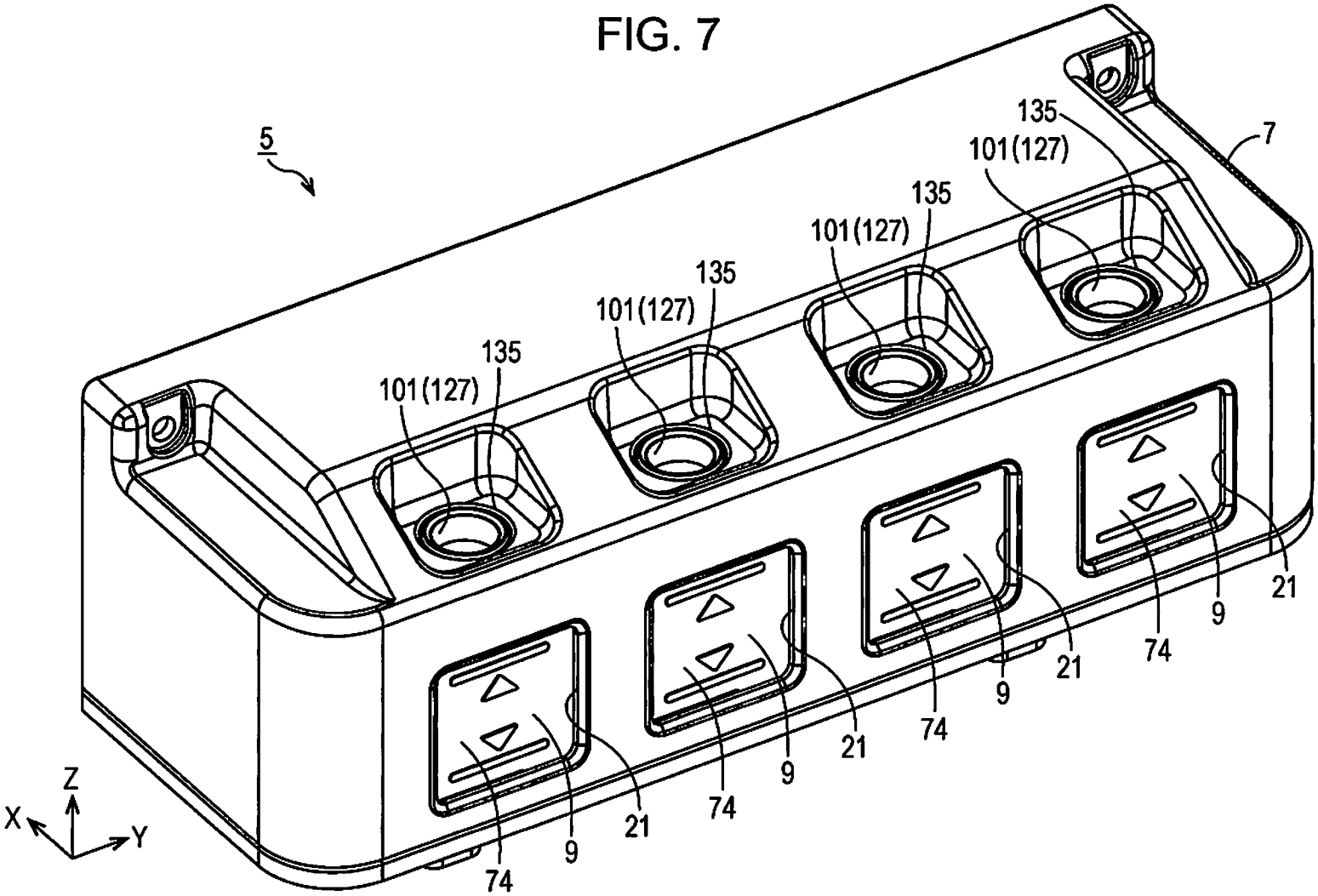
FIG. 7 is a perspective view illustrating an ink tank unit according to the first embodiment.
Figure 8:
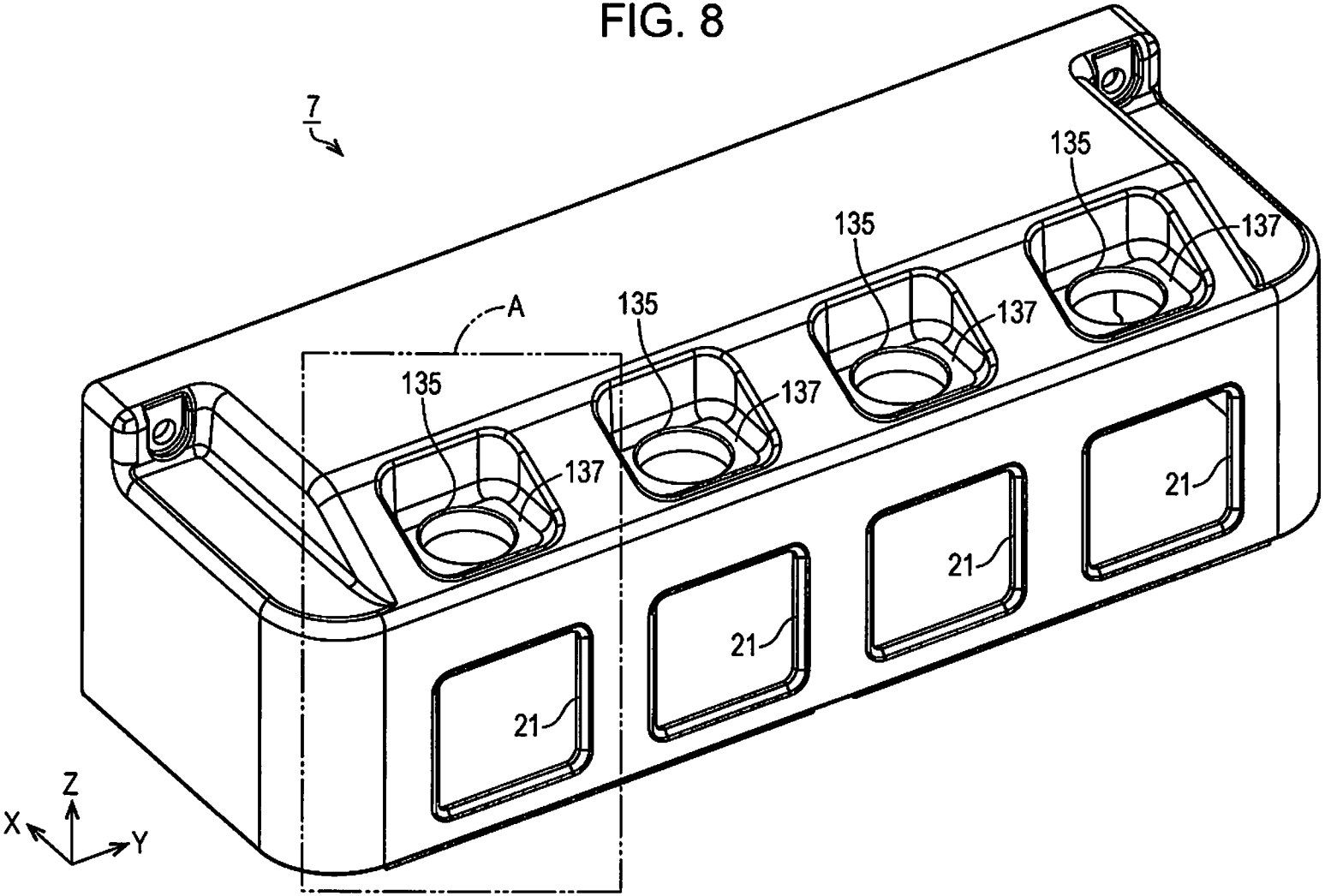
FIG. 8 is a perspective view illustrating a second case according to the first embodiment.

As illustrated in FIG. 7, the second case 7 covers the four ink tanks 9 in the ink tank unit 5. As illustrated in FIG. 8, the four window sections 21 and four openings 135 are provided on the second case 7. As illustrated in FIG. 7, the four window sections 21 are provided at positions facing the third wall 73 of the ink tank 9. In this manner, the third wall 73 of the ink tank 9 faces the window section 21 of the second case 7. In the present embodiment, the ink tank 9 is configured of an optically transparent material. Thus, the operator visually recognizes the four ink tanks 9 through the window sections 21 and thereby it is possible to visually recognize an amount of ink in the ink tank 9. In addition, the four openings 135 are provided at positions which overlap with the ink filling unit 101 of the ink tank 9. The four openings 135 penetrate through the second case 7. Thus, the ink filling unit 101 of the ink tank 9 is exposed on the outside of the second case 7 through the opening 135.

Figure 9:
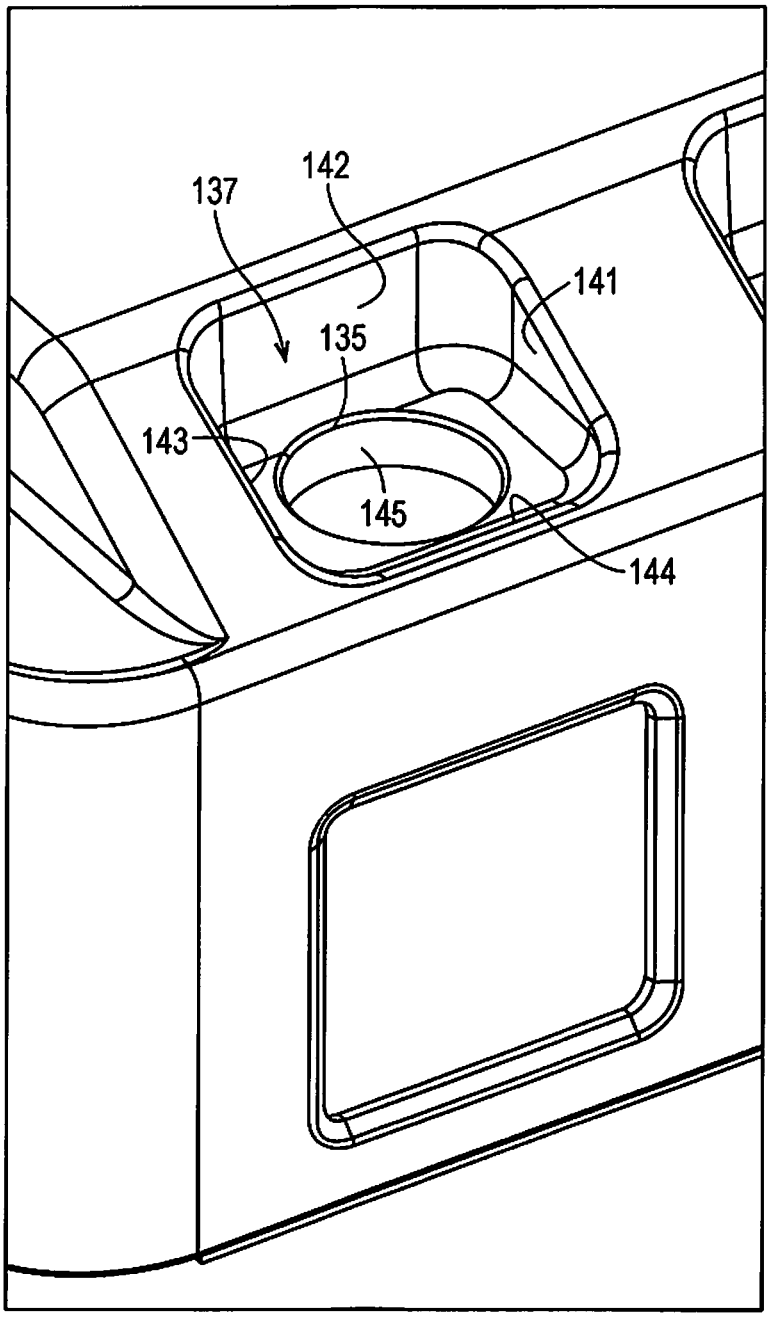
FIG. 9 is an enlarged view of portion A in FIG. 8.

As illustrated in FIG. 9 showing an enlarged view of portion A in FIG. 8, a recessed section 137 is provided in a peripheral section of the opening 135 in the second case 7. The recessed section 137 has a bottom 139. The bottom 139 is a wall of the ink tank 9, which faces the fifth wall 75. The bottom 139 is surrounded by the side wall 141, a side wall 142, a side wall 143, and a side wall 144. The recessed section 137 having the configuration described above is provided to be recessed toward the −Z axial direction. The opening 135 is open in the bottom 139. The opening 135 is surrounded by a side wall 145. The side wall 145 is provided on the ink tank 9 side of the bottom 139. The side wall 145 protrudes toward the ink tank 9 side from the bottom 139. Thus, the side wall 145 can be described to be perpendicularly downward toward the inside of the second case 7 from the bottom 139.

Figure 10:
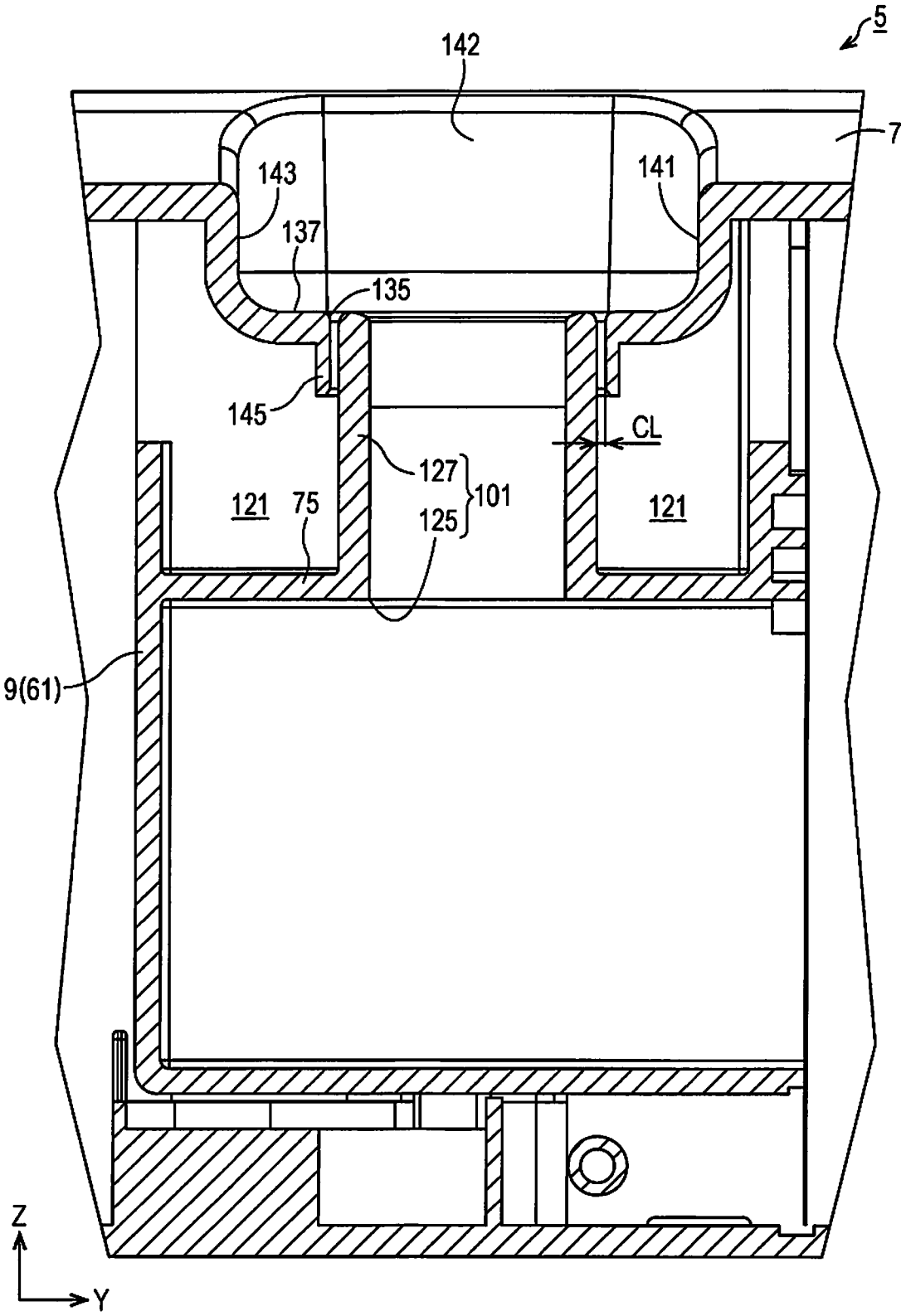
FIG. 10 is a sectional view illustrating an ink tank unit cut in an YZ plane through the ink filling unit according to the first embodiment.

In a plan view of the opening 135, a region surrounded by the opening 135 and the side wall 145 is greater than a region surrounded by the outer circumference of the side wall 127 of the ink filling unit 101. In other words, the side wall 127 of the ink filling unit 101 can be inserted into the region surrounded by the opening 135 and the side wall 145. In the present embodiment, as illustrated in FIG. 10 showing a sectional view of the ink filling unit 101 cut in an XZ plane, in the ink tank unit 5, the side wall 127 of the ink filling unit 101 is inserted into the region surrounded by the opening 135 and the side wall 145. A predetermined clearance CL is formed between the inner circumference of the side wall 145 and the outer circumference of the side wall 127.

In addition, in the ink tank unit 5, in a plan view of the opening 135, the inner circumference of the side wall 145 as an example of a first wall section is positioned in a region overlapping with the recessed section 121 of the ink tank 9. Thus, the second case 7 covers at least a part of the recessed section 121 of the ink tank 9. In the configuration described above, the side wall 145 has a function as a guide path which guides the ink attached to the second case 7 into the recessed section 121. In the present embodiment, since the side wall 145 is provided, for example, the side wall 145 causes the ink dripped to the recessed section 137, the ink spilled out from the ink filling unit 101, or the like, to be guided into the recessed section 121. In this manner, it is easy to avoid spreading of the ink attached to the ink tank 9 or the second case 7.

Figure 11:
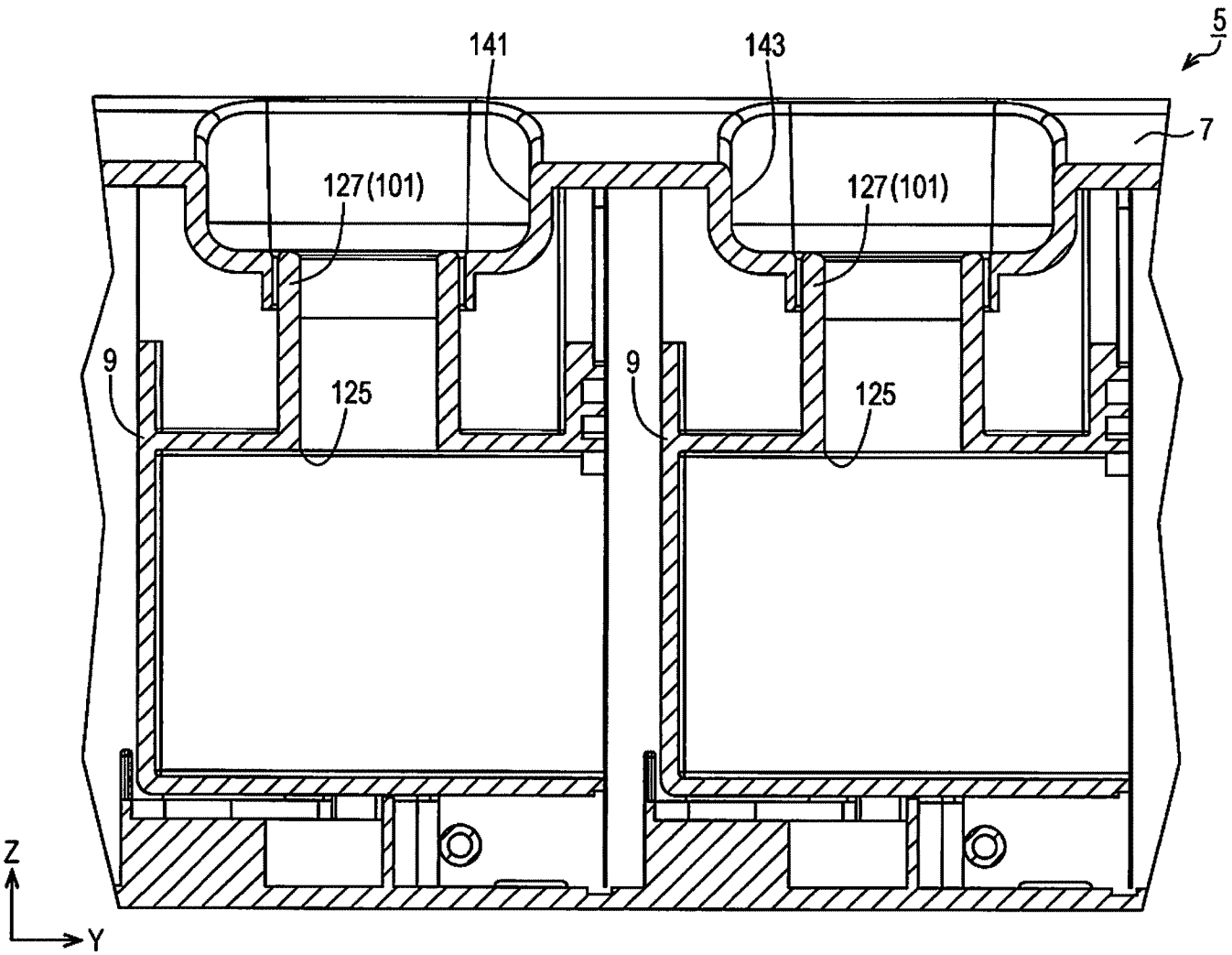
FIG. 11 is a sectional view illustrating the ink tank unit cut in an YZ plane through the ink filling unit according to the first embodiment.

Here, the side wall 127 of the ink filling unit 101 is accommodated in the recessed section 137 in the Z axial direction. In other words, the side wall 141 to the side wall 144 which configure the recessed section 137 protrude in the Z axial direction from the side wall 127 of the ink filling unit 101 to the +Z axial direction side. Thus, as illustrated in FIG. 11, the two adjacent ink tanks 9 are separated from each other by the side wall 141 and the side wall 143 which protrude from the side wall 127 to the +Z axial direction side. The side wall 141 and the side wall 143 extend in a direction intersecting with a direction in which openings 125 of the two adjacent ink tanks 9 are arranged in parallel.

In this manner, the two adjacent ink tanks 9 are partitioned from each other by the side wall 141 protruding from the side wall 127 to the +Z axial direction side. Similarly, it is considered that the two adjacent ink tanks 9 are partitioned from each other by the side wall 143 protruding from the side wall 127 to the +Z axial direction side. Thus, in the ink tank unit 5, the two adjacent ink tanks 9 are blocked from each other by the side wall 141 or the side wall 143 as an example of a second wall section. As above, the ink spilled out or leaked out from the ink filling unit 101 of the ink tank 9 is suppressed not to flow in another ink filling unit 101 of another ink tank 9.

Figure 12:
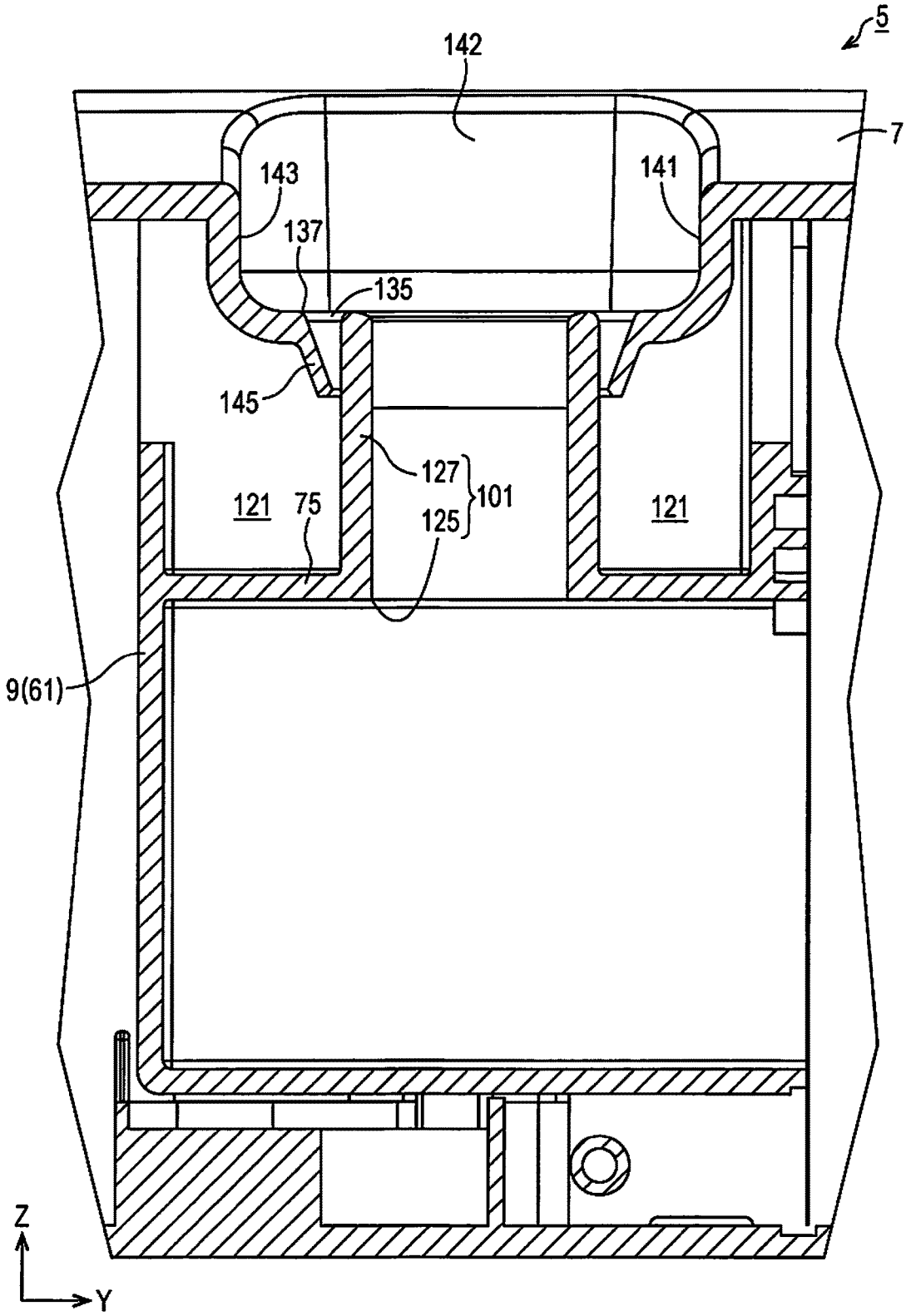
FIG. 12 is a sectional view illustrating another example of a side wall according to the first embodiment.

In the present embodiment, the side wall 145 as an example of a first wall section is configured to have a cylindrical shape; however, the configuration of the side wall 145 is not limited to the cylindrical shape. As illustrated in FIG. 12, for example, as a configuration of the side wall 145, an inverted cone shape may be employed. In the inverted cone-shaped side wall 145, an inner surface of the side wall 145 is inclined to approach the side wall 127 toward the −Z axial direction side. This configuration can also achieve the effects described above.

In addition, in the present embodiment, an example is described, in which the recessed section 121 provided in the ink tank 9 is used as an ink receiving section; however, the ink receiving section is not limited thereto. For example, as the ink receiving section, an absorber having a property of absorbing ink may be employed. When the recessed section 121 is omitted, an absorber is provided on the peripheral section of the ink filling unit 101 and thereby, it is possible to cause the absorber to have a function as an ink receiving section. This configuration can also achieve the effects described above. Further, a configuration may be employed, in which the absorber is provided in the recessed section 121. According to the configuration, since it is possible to hold the ink accumulated in the recessed section 121, it is easier to avoid spreading of the ink attached to the ink tank 9 or the second case 7.

In addition, in the present embodiment, the configuration is employed, in which the side wall 145 as an example of the first wall section is provided in the second case 7 and the configuration of the first wall section is not limited thereto. For example, a configuration in which the first wall section is provided in the ink tank 9 may be employed. In the configuration, it is also possible to use the first wall section provided in the ink tank 9, as a guide path.

In addition, in the present embodiment, the configuration in which the recessed section 121 as an example of the ink receiving section is provided in the ink tank 9 is employed; however, the configuration of the ink receiving section is not limited thereto. For example, a configuration in which the ink receiving section is provided in the second case 7 may be employed. In the configuration, it is also possible to achieve the effects that it is easy to avoid spreading of the ink attached to the ink tank 9 or the second case 7.

Further, a configuration may be employed, in which the ink receiving section and the guide path are provided to the ink tank 9 and the ink receiving section and the guide path are also provided in the second case 7. According to the configuration, it is easier to avoid spreading of the ink attached to the ink tank 9 or the second case 7.

In addition, in the present embodiment, the side wall 141 or the side wall 143 as an example of second wall section is provided in the second case 7; however, the configuration of the second wall section is not limited thereto. For example, a configuration may be employed, in which the second wall section is provided in the ink tank 9. This configuration can also achieve the effects described above. Further, for example, a configuration may be employed, in which the second wall section is provided in both the second case 7 and the ink tank 9. According to the configuration, the ink spilled out or leaked out from one ink filling unit 101 of one ink tank 9 is further suppressed not to flow into another ink filling unit 101 of another ink tank 9. In addition, a configuration in which the two adjacent ink tanks 9 are partitioned from each other is not limited to the second wall section protruding from the side wall 127 to the +Z axial direction but a configuration of partitioning using a groove may be employed.

Second Embodiment

A second embodiment will be described. The printer 1 according to the second embodiment has the same configuration as the printer 1 according to the first embodiment except for a different configuration of the ink tank 9. Thus, hereinafter, the same reference sign as in the first embodiment will be attached to the same configuration as in the first embodiment and a detailed description thereof will be omitted. In addition, hereinafter, the ink tank 9 according to the second embodiment will be referred to as an ink tank 9B. In this manner, the ink tank 9 according to the first embodiment is distinguished from the ink tank 9B according to the second embodiment.

Further, the second embodiment includes a plurality of examples. Hereinafter, the examples according to the second embodiment are referred to as examples B. Hereinafter, a reference number is attached to each of the plurality of examples B and thereby, the plurality of examples B are distinguished from each other. In addition, a reference number is attached to each of the ink tanks 9B corresponding to the plurality of examples B and thereby, the ink tanks 9B are distinguished for each examples B.

Example B1

Figure 13:
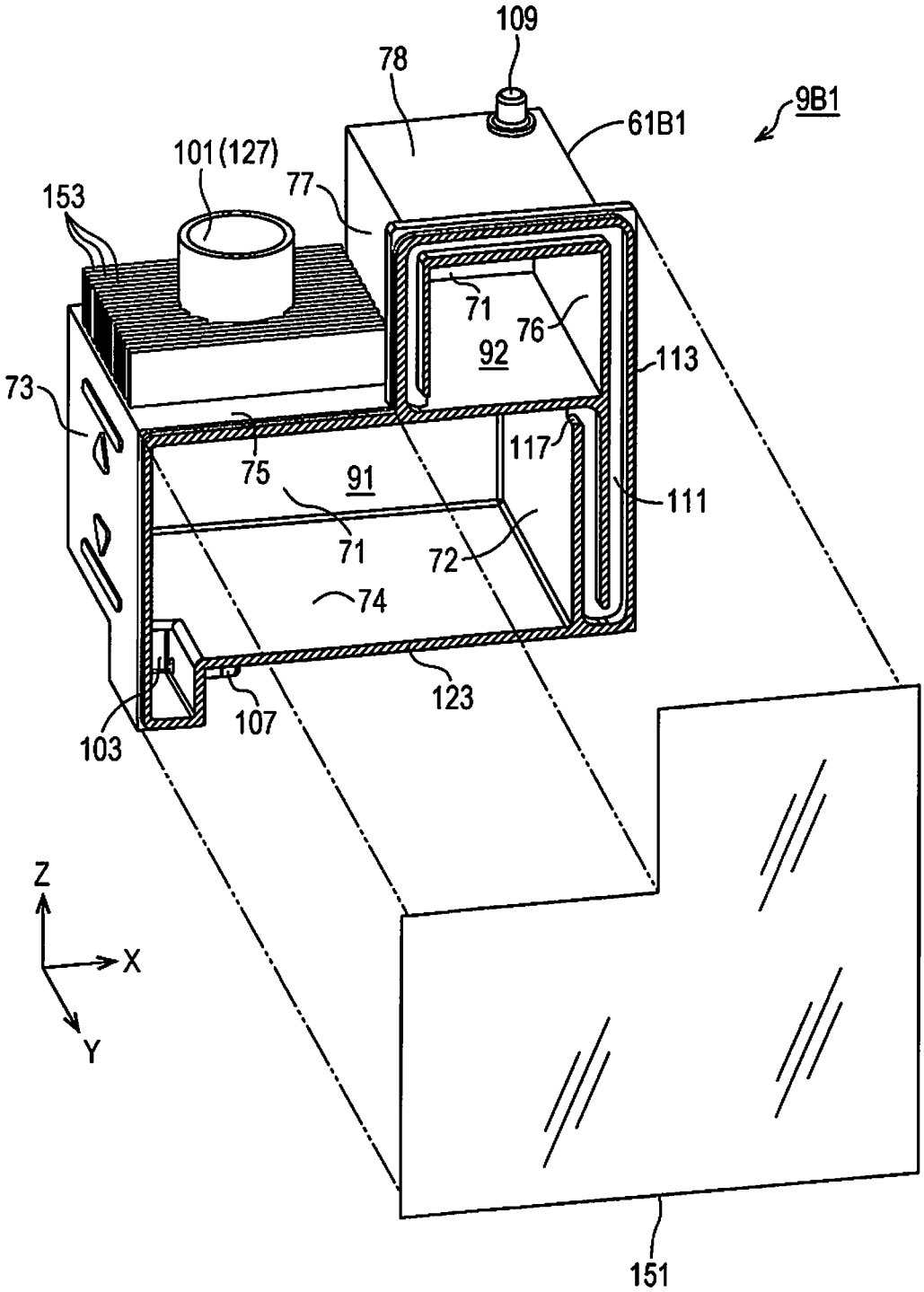
FIG. 13 is an exploded perspective view illustrating an ink tank according to an example B1.

As illustrated in FIG. 13, the ink tank 9B1 of the example B1 includes a case 61B1 and a sheet member 151. In the case 61B1, the recessed section 121 (FIG. 4) in the case 61 is omitted and a plurality of (two or more) ribs 153 are provided. Except for that, the case 61B1 has the same configuration as the case 61 according to the first embodiment. Thus, hereinafter, the same reference sign as in the first embodiment will be attached to the same configuration as in the first embodiment and a detailed description thereof will be omitted. In addition, the sheet member 151 has the same configuration as the sheet member 63 except that an outline has a different shape.

Figure 14:
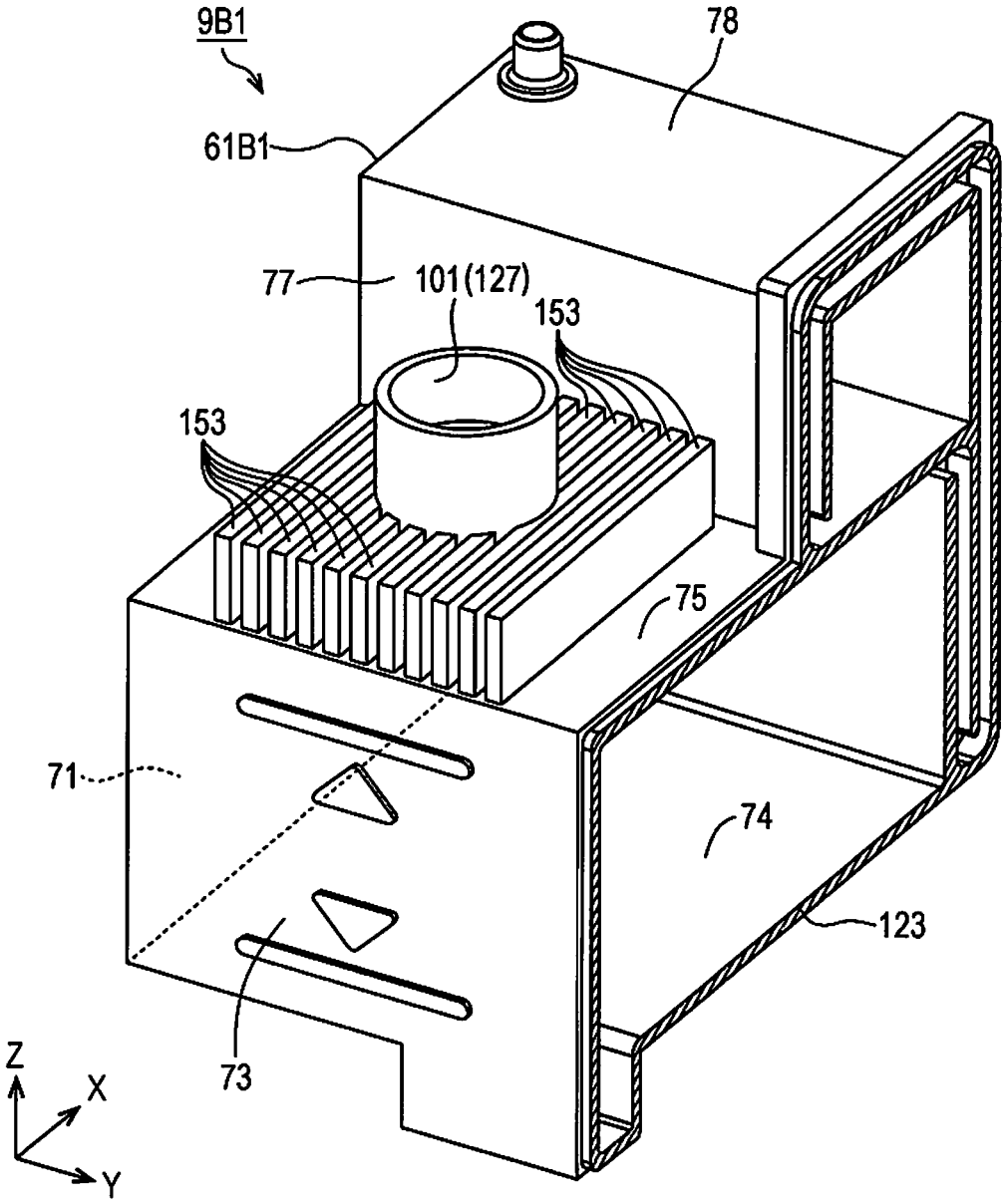
FIG. 14 is a perspective view illustrating a case according to the example B1.

As illustrated in FIG. 14, the plurality of ribs 153 are provided on a region of the fifth wall 75 on the third wall 73 side from the seventh wall 77, that is, on the peripheral section of the ink filling unit 101. The plurality of ribs 153 are provided on the side of the fifth wall 75 opposite to the fourth wall 74 and protrude from the fifth wall 75 toward the side opposite to the fourth wall 74. The plurality of ribs 153 extend in the X axial direction. The plurality of ribs 153 extend over a distance further from the third wall 73 side than the ink filling unit 101 further to the seventh wall 77 than the ink filling unit 101. In addition, the plurality of ribs 153 are provided in the Y axial direction over a region further from the first wall 71 side than the ink filling unit 101 further to the adhesion section 123 side than the ink filling unit 101. A clearance in which ink can be held between the ribs 153 due to a capillary force is formed between the two adjacent ribs 153.

According to the configuration described above, in the ink tank 9B 1, ink spilled out or leaked out from the ink filling unit 101 can be held between the two or more ribs 153. In this manner, it is easy to avoid spreading of the ink spilled out or leaked out from the ink filling unit 101. In addition, in the ink tank 9B1, since the two adjacent ribs 153 extend in the same direction as each other, a volume of ink which can be held between the ribs 153 is likely to increase. At least a part of the ribs 153 among the plurality of ribs 153 are connected to the outer circumference of the side wall 127 of the ink filling unit 101. Thus, it is possible to reinforce the side wall 127 by the ribs 153 connected to the outer circumference of the side wall 127.

Example B2

An ink tank 9B2 of the example B2 includes a case 61B2. In the ink tank 9B2 of the example B2, the case 61B1 of the ink tank 9B1 according to the example B1 is changed to the case 61B2. Except for that, the ink tank 9B2 of the example B2 has the same configuration as the ink tank 9B 1 of the example B1. Thus, hereinafter, the same reference sign as in the example B1 will be attached to the same configuration as in the example B1 and a detailed description thereof will be omitted.

Figure 15:
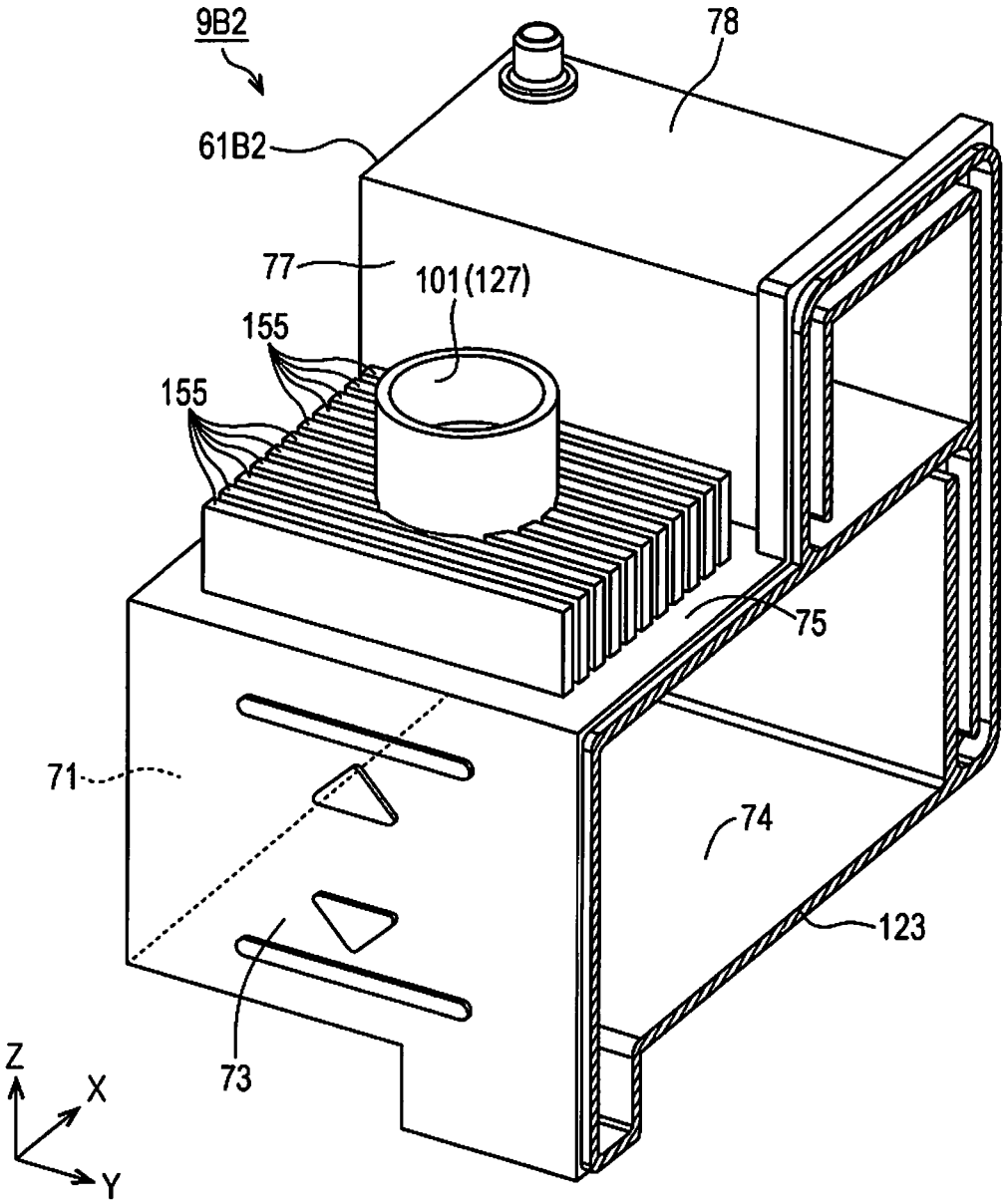
FIG. 15 is a perspective view illustrating a case according to the example B2.

As illustrated in FIG. 15, the case 61B2 includes the plurality of ribs 155. In the case 61B2, the plurality of ribs 153 in the case 61B1 of the example B1 are changed to plurality of ribs 155. Except for that, the case 61B2 of the example B2 has the same configuration as the case 61B1 of the example B1. Thus, hereinafter, the same reference sign as in the example B1 will be attached to the same configuration as in the example B1 and a detailed description thereof will be omitted.

The plurality of ribs 155 are provided on a region of the fifth wall 75 on the third wall 73 side from the seventh wall 77, that is, on the peripheral section of the ink filling unit 101. The plurality of ribs 155 are provided on the side of the fifth wall 75 opposite to the fourth wall 74 and protrude from the fifth wall 75 toward the side opposite to the fourth wall 74. The plurality of ribs 155 extend in the Y axial direction. The plurality of ribs 155 extend over a distance further from the first wall 71 side than the ink filling unit 101 further to the adhesion section 123 side than the ink filling unit 101. In addition, the plurality of ribs 155 are provided in the X axial direction over a region further from the third wall 73 side than the ink filling unit 101 further to the seventh wall 77 side than the ink filling unit 101. A clearance in which ink can be held between the ribs 155 due to a capillary force is formed between the two adjacent ribs 155.

According to the configuration described above, in the ink tank 9B2, ink spilled out or leaked out from the ink filling unit 101 can be held between the two or more ribs 155. In this manner, it is easy to avoid spreading of the ink spilled out or leaked out from the ink filling unit 101. In addition, in the ink tank 9B2, since the two adjacent ribs 155 extend in the same direction as each other, a volume of ink which can be held between the ribs 155 is likely to increase. At least a part of the ribs 155 among the plurality of ribs 155 are connected to the outer circumference of the side wall 127 of the ink filling unit 101. Thus, it is possible to reinforce the side wall 127 by the ribs 155 connected to the outer circumference of the side wall 127.

Example B3

An ink tank 9B3 of the example B3 includes a case 61B3. In the ink tank 9B3 of the example B3, the case 61B1 of the ink tank 9B1 according to the example B1 is changed to the case 61B3. Except for that, the ink tank 9B3 of the example B3 has the same configuration as the ink tank 9B1 of the example B1. Thus, hereinafter, the same reference sign as in the example B1 will be attached to the same configuration as in the example B1 and a detailed description thereof will be omitted.

Figure 16:
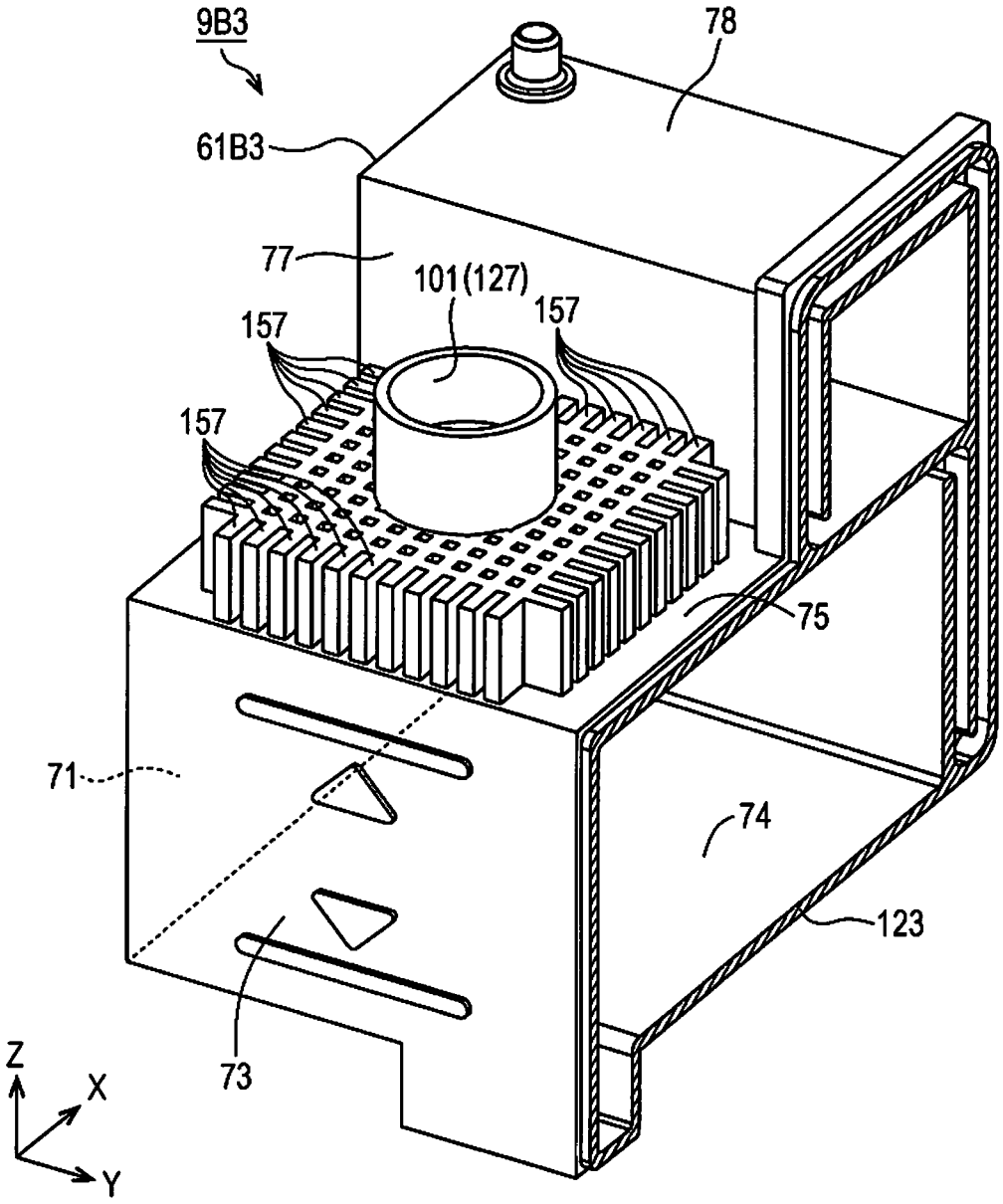
FIG. 16 is a perspective view illustrating a case according to the example B3.

As illustrated in FIG. 16, the case 61B3 includes the plurality of ribs 157. In the case 61B3, the plurality of ribs 153 in the case 61B1 of the example B1 are changed to plurality of ribs 157. Except for that, the case 61B3 of the example B3 has the same configuration as the case 61B1 of the example B1. Thus, hereinafter, the same reference sign as in the example B1 will be attached to the same configuration as in the example B1 and a detailed description thereof will be omitted.

The plurality of ribs 157 are provided on a region of the fifth wall 75 on the third wall 73 side from the seventh wall 77, that is, on the peripheral section of the ink filling unit 101. The plurality of ribs 157 are provided on the side of the fifth wall 75 opposite to the fourth wall 74 and protrude from the fifth wall 75 toward the side opposite to the fourth wall 74. The plurality of ribs 157 extend in both the X axial direction and the Y axial direction. The plurality of ribs 157 extend over a distance further from the first wall 71 side than the ink filling unit 101 further to the adhesion section 123 side than the ink filling unit 101, in the X axial direction. In addition, the plurality of ribs 157 are provided over a distance further from the third wall 73 side than the ink filling unit 101 further to the seventh wall 77 side than the ink filling unit 101, in the Y axial direction. The plurality of ribs 157 extending in the X axial direction intersect with the plurality of ribs 157 extending in the Y axial direction. Thus, in the case 61B3, the plurality of ribs 157 are provided in a grid shape. A clearance in which ink can be held between the ribs 157 due to a capillary force is formed between the two adjacent ribs 157.

According to the configuration described above, in the ink tank 9B3, ink spilled out or leaked out from the ink filling unit 101 is likely to remain in the grid of the plurality of ribs 157 which are provided in the grid shape. In this manner, it is easy to avoid spreading of the ink spilled out or leaked out from the ink filling unit 101. At least a part of the ribs 157 among the plurality of ribs 157 are connected to the outer circumference of the side wall 127 of the ink filling unit 101. Thus, it is possible to reinforce the side wall 127 by the ribs 157 connected to the outer circumference of the side wall 127. In addition, in the ink tank 9B3, since the plurality of ribs 157 extending in the X axial direction intersect with the plurality of the ribs 157 extending the Y axial direction, it is possible to reinforce the plurality of ribs 157 with each other.

Example B4

An ink tank 9B4 of the example B4 includes a case 61B4. In the ink tank 9B4 of the example B4, the case 61B1 of the ink tank 9B1 according to the example B1 is changed to the case 61B4. Except for that, the ink tank 9B4 of the example B4 has the same configuration as the ink tank 9B 1 of the example B1. Thus, hereinafter, the same reference sign as in the example B1 will be attached to the same configuration as in the example B1 and a detailed description thereof will be omitted.

Figure 17:
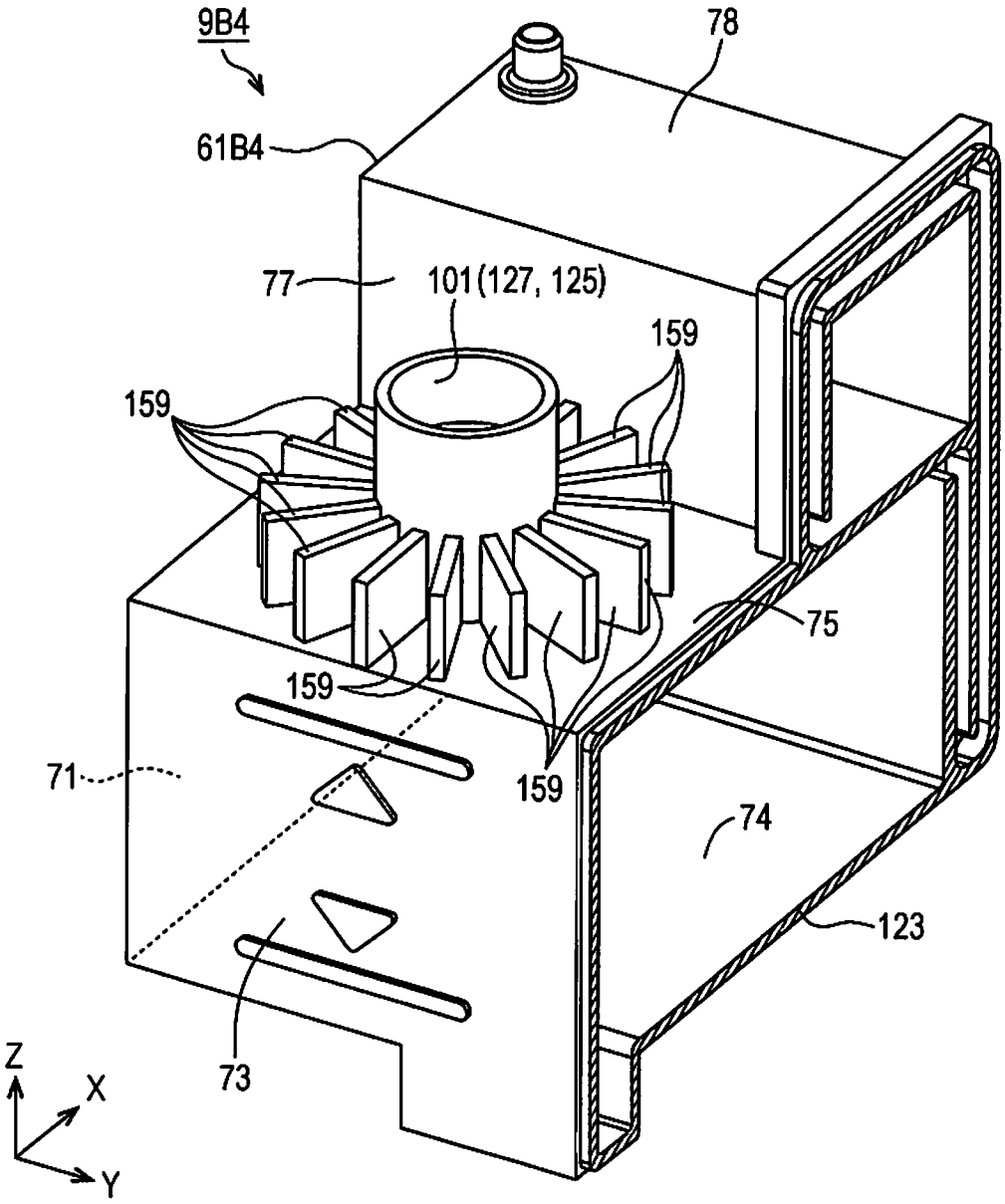
FIG. 17 is a perspective view illustrating a case according to the example B4.

As illustrated in FIG. 17, the case 61B4 includes the plurality of ribs 159. In the case 61B4, the plurality of ribs 153 in the case 61B1 of the example B1 are changed to plurality of ribs 159. Except for that, the case 61B4 of the example B4 has the same configuration as the case 61B1 of the example B1. Thus, hereinafter, the same reference sign as in the example B1 will be attached to the same configuration as in the example B1 and a detailed description thereof will be omitted.

The plurality of ribs 159 are provided on a region of the fifth wall 75 on the third wall 73 side from the seventh wall 77, that is, on the peripheral section of the ink filling unit 101. The plurality of ribs 159 are provided on the side of the fifth wall 75 opposite to the fourth wall 74 and protrude from the fifth wall 75 toward the side opposite to the fourth wall 74. The plurality of ribs 159 are provided radially around the opening 125 in a plan view of the opening 125 of the ink filling unit 101. A clearance in which ink can be held between the ribs 159 due to a capillary force is formed between the two adjacent ribs 159.

According to the configuration described above, in the ink tank 9B4, it is possible to hold ink spilled out or leaked out from the ink filling unit 101, between the two or more ribs 159. In this manner, it is easy to avoid spreading of the ink spilled out or leaked out from the ink filling unit 101. In addition, in the ink tank 9B4, since the plurality of the ribs 159 are provided radially around the opening 125, it is possible to efficiently dispose the plurality of ribs 159 around the ink filling unit 101. The plurality of the ribs 159 are connected to the outer circumference of the side wall 127 of the ink filling unit 101. Thus, it is possible to reinforce the side wall 127 by the plurality of ribs 159 connected to the outer circumference of the side wall 127.

Example B5

An ink tank 9B5 of the example B5 includes a case 61B5. In the ink tank 9B5 of the example B5, the case 61B1 of the ink tank 9B1 according to the example B1 is changed to the case 61B5. Except for that, the ink tank 9B5 of the example B5 has the same configuration as the ink tank 9B 1 of the example B1. Thus, hereinafter, the same reference sign as in the example B1 will be attached to the same configuration as in the example B1 and a detailed description thereof will be omitted.

Figure 18:
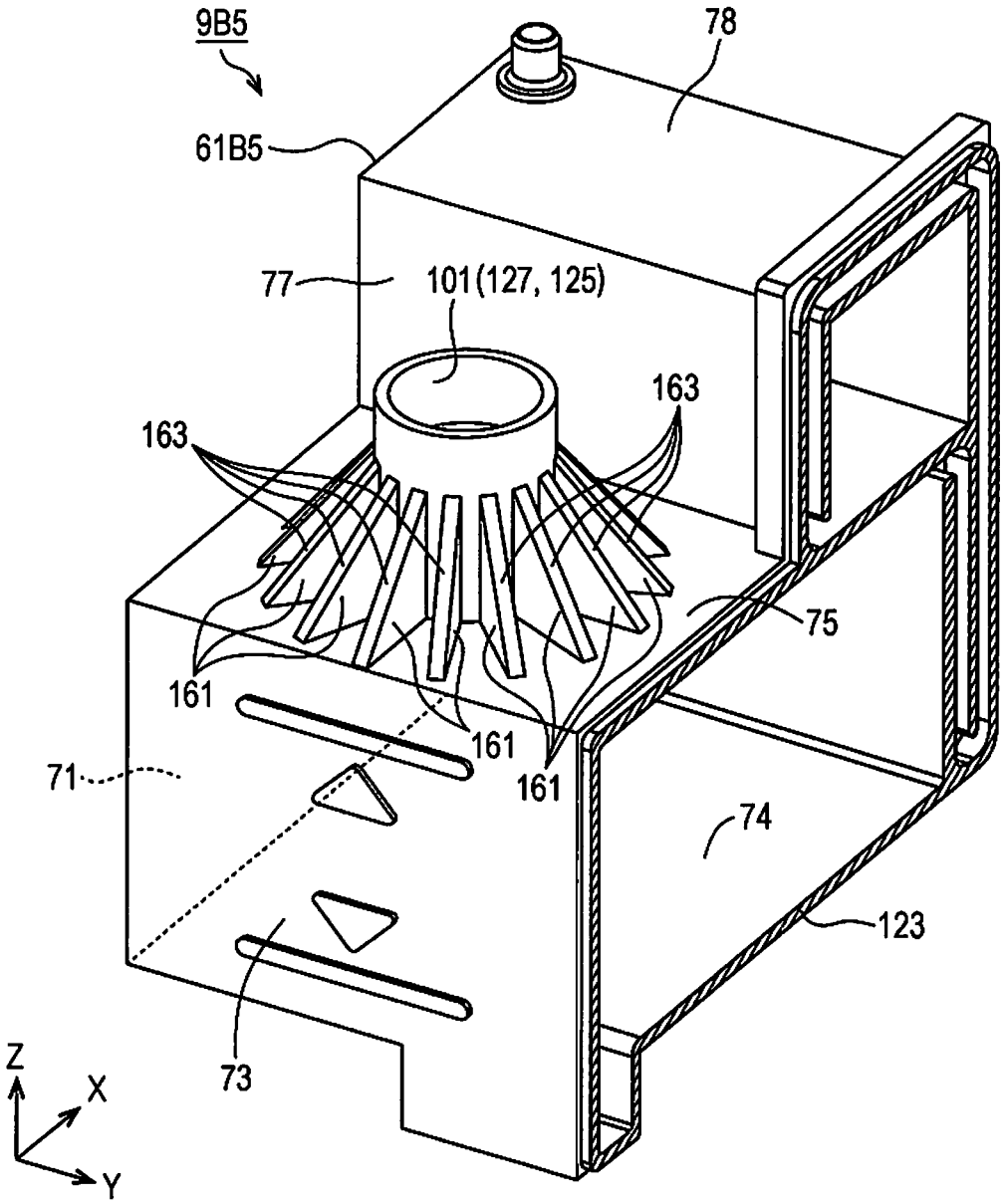
FIG. 18 is a perspective view illustrating a case according to the example B5.

As illustrated in FIG. 18, the case 61B5 includes the plurality of ribs 161. In the case 61B5, the plurality of ribs 153 in the case 61B1 of the example B1 are changed to plurality of ribs 161. Except for that, the case 61B5 of the example B5 has the same configuration as the case 61B1 of the example B1. Thus, hereinafter, the same reference sign as in the example B1 will be attached to the same configuration as in the example B1 and a detailed description thereof will be omitted.

The plurality of ribs 161 are provided on a region of the fifth wall 75 on the third wall 73 side from the seventh wall 77, that is, on the peripheral section of the ink filling unit 101. The plurality of ribs 161 are provided on the side of the fifth wall 75 opposite to the fourth wall 74 and protrude from the fifth wall 75 toward the side opposite to the fourth wall 74. The plurality of ribs 161 are provided radially around the opening 125 in a plan view of the opening 125 of the ink filling unit 101. A clearance in which ink can be held between the ribs 161 due to a capillary force is formed between the two adjacent ribs 161. In addition, in the ink tank 9B5, slopes 163 are provided on the plurality of ribs 161, respectively. The slope 163 is inclined to approach the fifth wall 75 as away from the ink filling unit 101.

According to the configuration described above, in the ink tank 9B5, it is possible to hold ink spilled out or leaked out from the ink filling unit 101, between the two or more ribs 161. In this manner, it is easy to avoid spreading of the ink spilled out or leaked out from the ink filling unit 101. In addition, in the ink tank 9B5, since the plurality of the ribs 161 are provided radially around the opening 125, it is possible to efficiently dispose the plurality of ribs 161 around the ink filling unit 101. In addition, in the ink tank 9B5, since the slopes 163 are provided on the ribs 161, the rib 161 is likely to be miniaturized. The plurality of the ribs 161 are connected to the outer circumference of the side wall 127 of the ink filling unit 101. Thus, it is possible to reinforce the side wall 127 by the plurality of ribs 161 connected to the outer circumference of the side wall 127.

According to the example B1 to example B5, a configuration may be employed, in which the recessed section 121 according to the first embodiment is provided. According to the configuration, it is easier to avoid spreading of the ink spilled out or leaked out from the ink filling unit 101.

Third Embodiment

A third embodiment will be described. The printer 1 according to the third embodiment has the same configuration as the printer 1 according to the first embodiment except for a different configuration of the ink tank 9. Thus, hereinafter, the same reference sign as in the first embodiment will be attached to the same configuration as in the first embodiment and a detailed description thereof will be omitted. In addition, hereinafter, the ink tank 9 according to the third embodiment will be referred to as an ink tank 9C. In this manner, the ink tank 9 according to the first embodiment is distinguished from the ink tank 9C according to the third embodiment.

Figure 19:
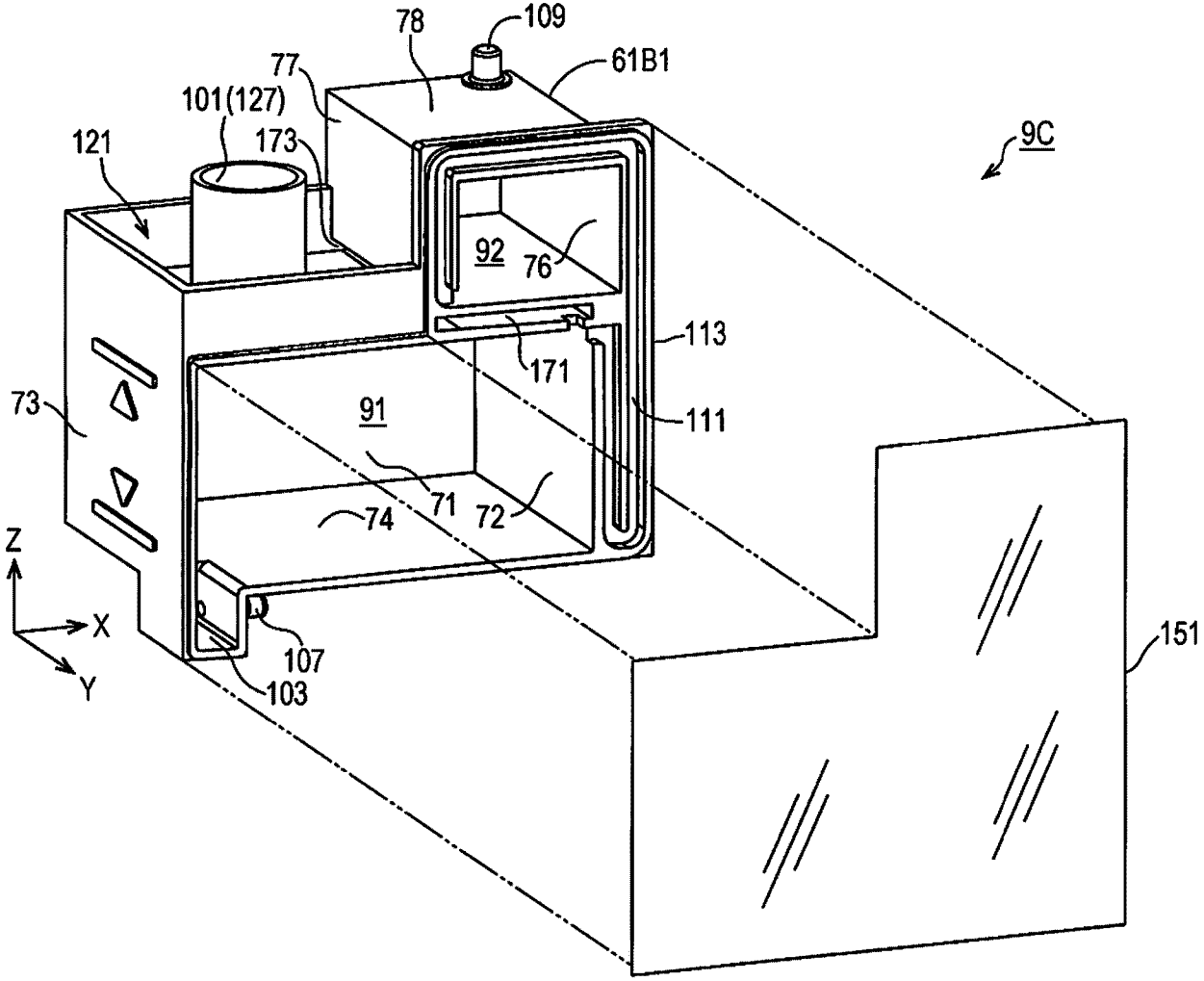
FIG. 19 is an exploded perspective view illustrating an ink tank according to a third embodiment.

As illustrated in FIG. 19, the ink tank 9C according to the third embodiment includes a case 61C and the sheet member 151. A recessed section 171 as an example of a second ink chamber is provided in the case 61C and an opening 173 is provided in the seventh wall 77. Except for that, the case 61C has the same configuration as the case 61 according to the first embodiment. Thus, hereinafter, the same reference sign as in the first embodiment will be attached to the same configuration as in the first embodiment and a detailed description thereof will be omitted. In addition, the sheet member 151 has the same as the sheet member 151 according to the second embodiment.

Figure 20:
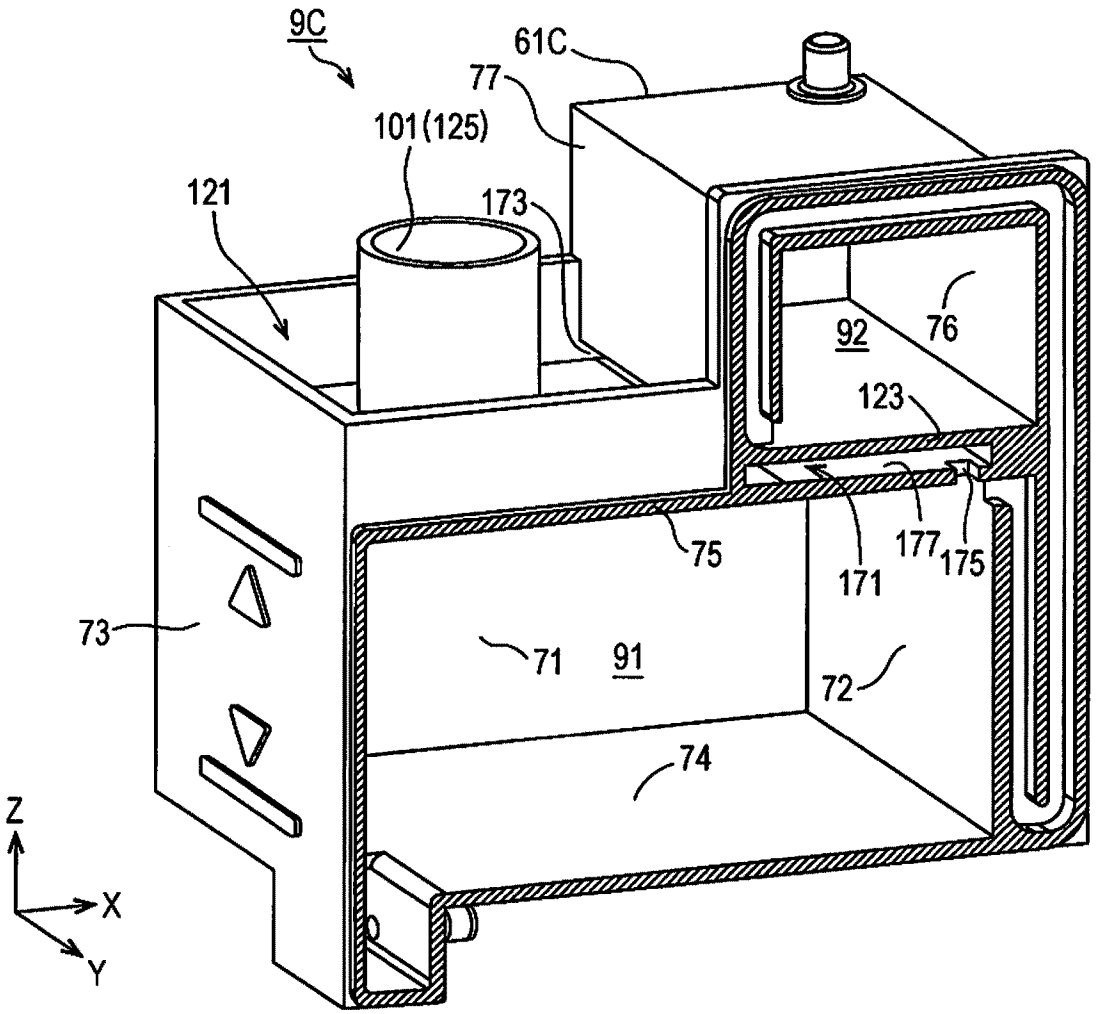
FIG. 20 is a perspective view illustrating a case according to the third embodiment.

As illustrated in FIG. 20, the opening 173 is provided at a portion of the seventh wall 77, which is positioned in the recessed section 121. In the present embodiment, the opening 173 is provided at a portion of the seventh wall 77, which intersects with the fifth wall 75. The inside of the recessed section 121 and the inside of the recessed section 171 communicate with each other through the opening 173. The adhesion section 123 is provided around the recessed section 171 except for a notched portion 175. Thus, when the sheet member 151 adheres to the adhesion section 123, the recessed section 171 and the recessed section 92 are partitioned from each other. The notched portion 175 is provided in the fifth wall 75 and is provided to be recessed toward the inside of the recessed section 171. The recessed section 171 and the recessed section 91 communicate with each other through the notched portion 175.

In the third embodiment, since the recessed section 121 is provided, it is possible to receive the ink spilled out from the ink filling unit 101 or the ink dripped during filling, in the recessed section 121. In this manner, it is easy to avoid wide spreading of the ink spilled out or leaked out from the ink filling unit 101. Further, since the recessed section 121 communicates with the recessed section 171 in the ink tank 9C, the ink received in the recessed section 121 is guided to the recessed section 171. Then, since the recessed section 171 communicates with the recessed section 91 as an example of the first ink chamber, the ink guided to the recessed section 171 is guided to the recessed section 91. In other words, in the ink tank 9C, it is possible to collect the ink spilled out or leaked out from the ink filling unit 101, in the recessed section 91 through the recessed section 121 and the recessed section 171. As a result, it is possible to effectively use the ink spilled out from the ink filling unit 101 or the ink dripped during filling.

In addition, an inclined surface 177 is provided in the recessed section 171 in the case 61C. The inclined surface 177 configures the bottom of the recessed section 171 in a state in which the opening 125 of the ink filling unit 101 directs perpendicularly upward. In a state in which the opening 125 of the ink filling unit 101 directs perpendicularly upward, the inclined surface 177 is inclined to be lowered toward the notched portion 175 side from the opening 173. Thus, the ink received in the recessed section 121 is likely to be guided into the recessed section 91.

In addition, since the sheet member 151 is optically transparent, at least a part of the wall, which faces the outside of the case 61C, of the wall of the recessed section 171 and the second ink chamber partitioned by the sheet member 151, is optically transparent. Accordingly, it is easy to visually recognize the recessed section 171 and the inside of the second ink chamber partitioned by the sheet member 151 through the sheet member 151. In this manner, it is possible to check a collecting condition of the ink to the recessed section 91 from the recessed section 171.

In addition, in the ink tank 9C, a flow resistance of the ink in the notched portion 175 is greater than a flow resistance of the ink in the ink filling unit 101. In this manner, the ink is suppressed not to flow into the recessed section 171 from the recessed section 91, which promotes ink filling into the recessed section 91.

Fourth Embodiment

A fourth embodiment will be described. The fourth embodiment relates to a valve unit which can be provided in the ink filling unit 101. The valve unit according to the fourth embodiment can be employed any one of the ink tank 9, the ink tank 9B, or the ink tank 9C. Further, the valve unit according to the fourth embodiment can also be employed in other ink tanks. Thus, in the fourth embodiment, a detailed description of the configuration of the ink tank will be omitted. In addition, according to the fourth embodiment, the same reference sign as in the first embodiment will be attached to the same configuration as in the first embodiment and a detailed description thereof will be omitted. In addition, hereinafter, the case of the ink tank to which a valve structure according to the fourth embodiment can be applied will be referred to as a case 181.

Figure 21:
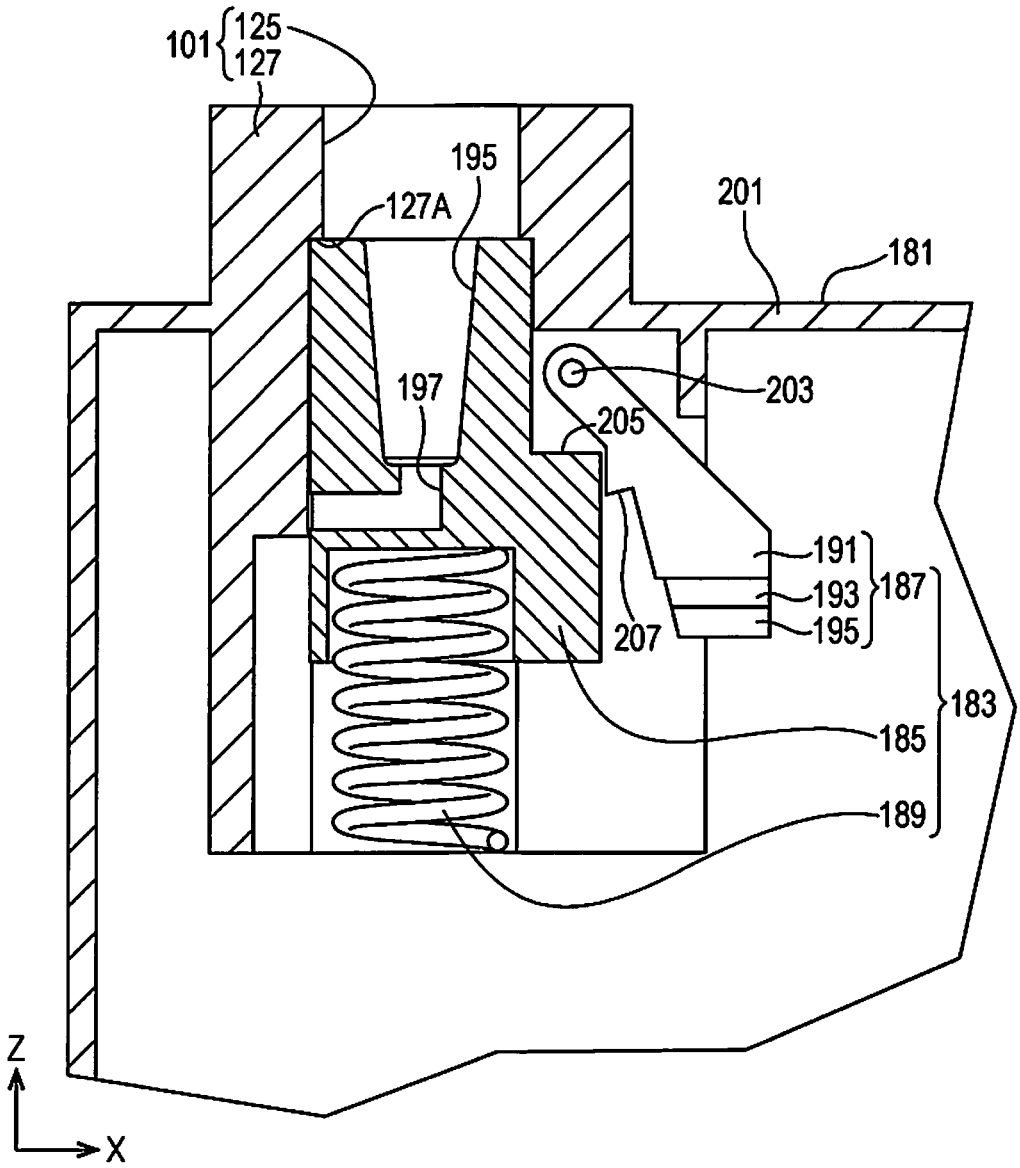
FIG. 21 is a sectional view illustrating a valve unit according to a fourth embodiment.

As illustrated in FIG. 21, a valve unit 183 according to the fourth embodiment includes a valve member 185, a locking lever 187 as an example of a float member, and a spring 189 as an example of a bias member. The locking lever 187 includes a lever main body 191, a weight unit 193, and a float 194. FIG. 21 shows a sectional view of the ink filling unit 101 and the valve unit 183 cut in an XZ plane. The valve member 185 is inserted into the side wall 127 of the ink filling unit 101 from the inside of the case 181. The opening 125 of the ink filling unit 101 is closed from the inner side of the case 181 by the valve member 185. A wall on which the ink filling unit 101 is provided in the case 181 is referred to as a wall 201.

The side wall 127 protrudes from the wall 201 toward the side opposite to the inner side of the case 181. Here, a step portion 127A is provided on the inner circumference of the side wall 127. The inner circumference of the side wall 127 becomes wide with the step portion 127A as a boundary. The inner circumference of the side wall 127 is wider on the inner side of the case 181 than the end side of the side wall 127. The valve member 185 bumps into the step portion 127A and thereby, the opening 125 enters into a state of being closed. The state in which the opening 125 is closed by the valve member 185 is referred to as a closed state.

The valve member 185 further reaches the inner side of the case 181 than the wall 201. An insertion port 195 is provided in the valve member 185. The insertion port 195 is provided to be recessed toward the inner side of the case 181 from the outer side of the case 181 in the valve member 185. A nozzle of a filling bottle to be described below is inserted into the insertion port 195. In addition, a flow path 197 is provided in the valve member 185. The flow path 197 is disposed from the outer circumferential surface of the valve member 185 through the bottom of the insertion port 195. The insertion port 195 communicates with the outside from the outer circumferential surface of the valve member 185 through the flow path 197. In the closed state, the flow path 197 is closed by the inner circumference of the side wall 127. Thus, in the closed state, the opening 125 of the ink filling unit 101 does not communicate with the inside of the case 181.

The spring 189 is provided further on the side opposite to the wall 201 side than the valve member 185. The spring 189 biases the valve member 185 from the inner side of the case 181 toward the outer side, that is, in a direction in which the valve member 185 bumps into the step portion 127A. In the closed state, the valve member 185 bumps into the step portion 127A due to the bias of the spring 189.

The lever main body 191 is configured to be rotatable around the shaft 203. An engagement section 207 which is able to engage with an engagement target section 205 provided in the valve member 185 is provided in the lever main body 191. The weight unit 193 is provided on the side of the lever main body 191 opposite to the wall 201, that is, on the lower side of the lever main body 191. In the closed state, the engagement section 207 of the lever main body 191 is disengaged from the engagement target section 205. In this state, when the opening 125 directs perpendicularly upward, a direction connecting the shaft 203 and the weight unit 193 intersects with a perpendicular direction. At this time, the weight unit 193 is positioned further on a side opposite to the valve member 185 side than the shaft 203. Thus, the lever main body 191 is biased by the weight unit 193 in a direction in which the weight unit 193 approaches the valve member 185. The float 194 is provided on the side opposite to the lever main body 191 side of the weight unit 193, that is, on the lower side of the weight unit 193.

Figure 22:
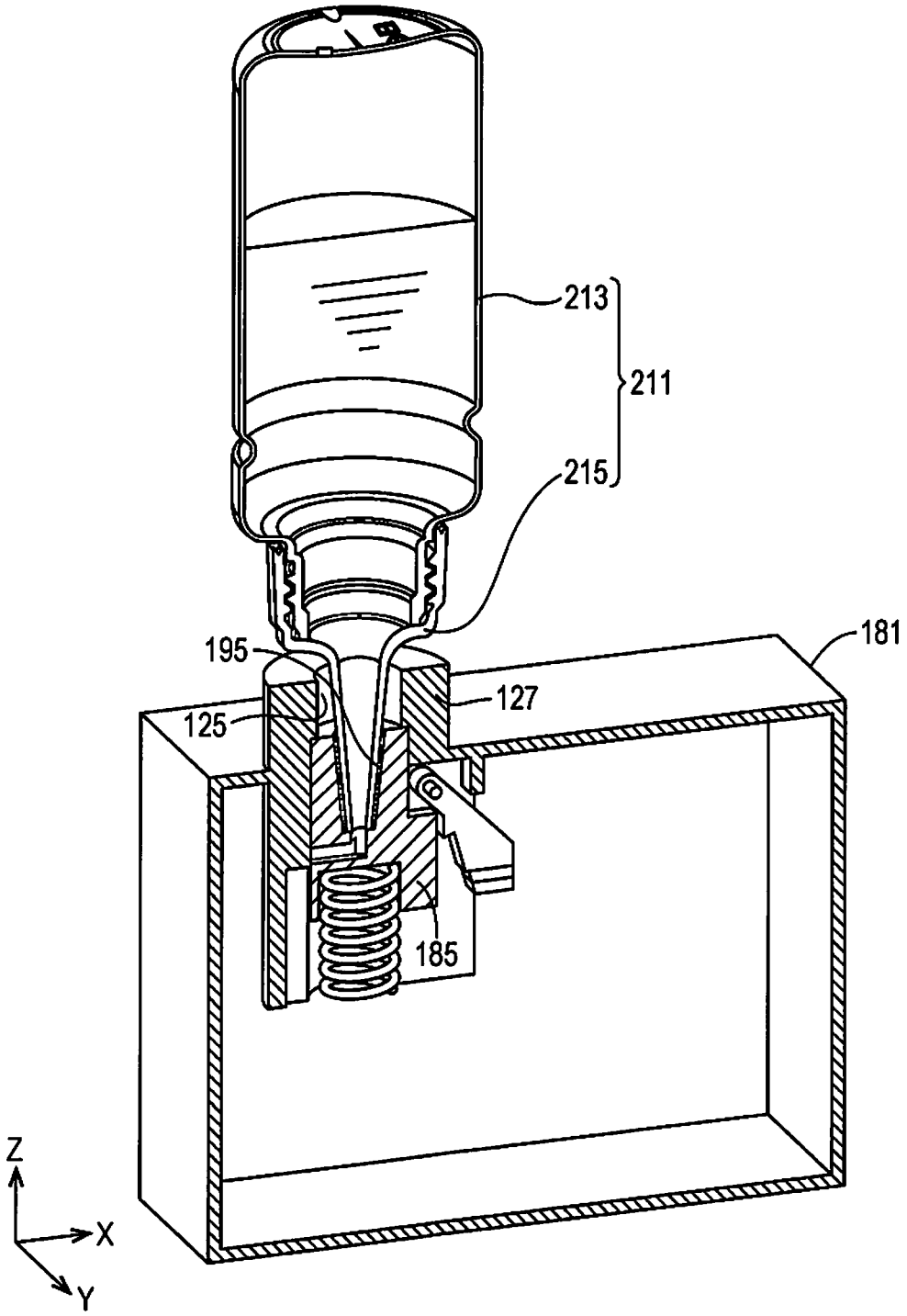
FIG. 22 is a sectional view illustrating the valve unit and a filling bottle according to the fourth embodiment.

As illustrated in FIG. 22, a filling bottle 211 includes a bottle main body 213, and a nozzle 215 as an example of a filling tool. FIG. 22 shows a state of the filling bottle 211 cut in an XZ plane. The bottle main body 213 is configured to be able to contain ink. The ink inside the bottle main body 213 can be discharged to the outside of the filling bottle 211 through the nozzle 215. The nozzle 215 is configured to be able to be inserted into the insertion port 195 of the valve member 185 through the opening 125. When the case 181 is filled with the ink in the filling bottle 211, an operator first pushes the valve member 185 in a depth direction of the opening 125 through the filling bottle 211.

Figure 23:
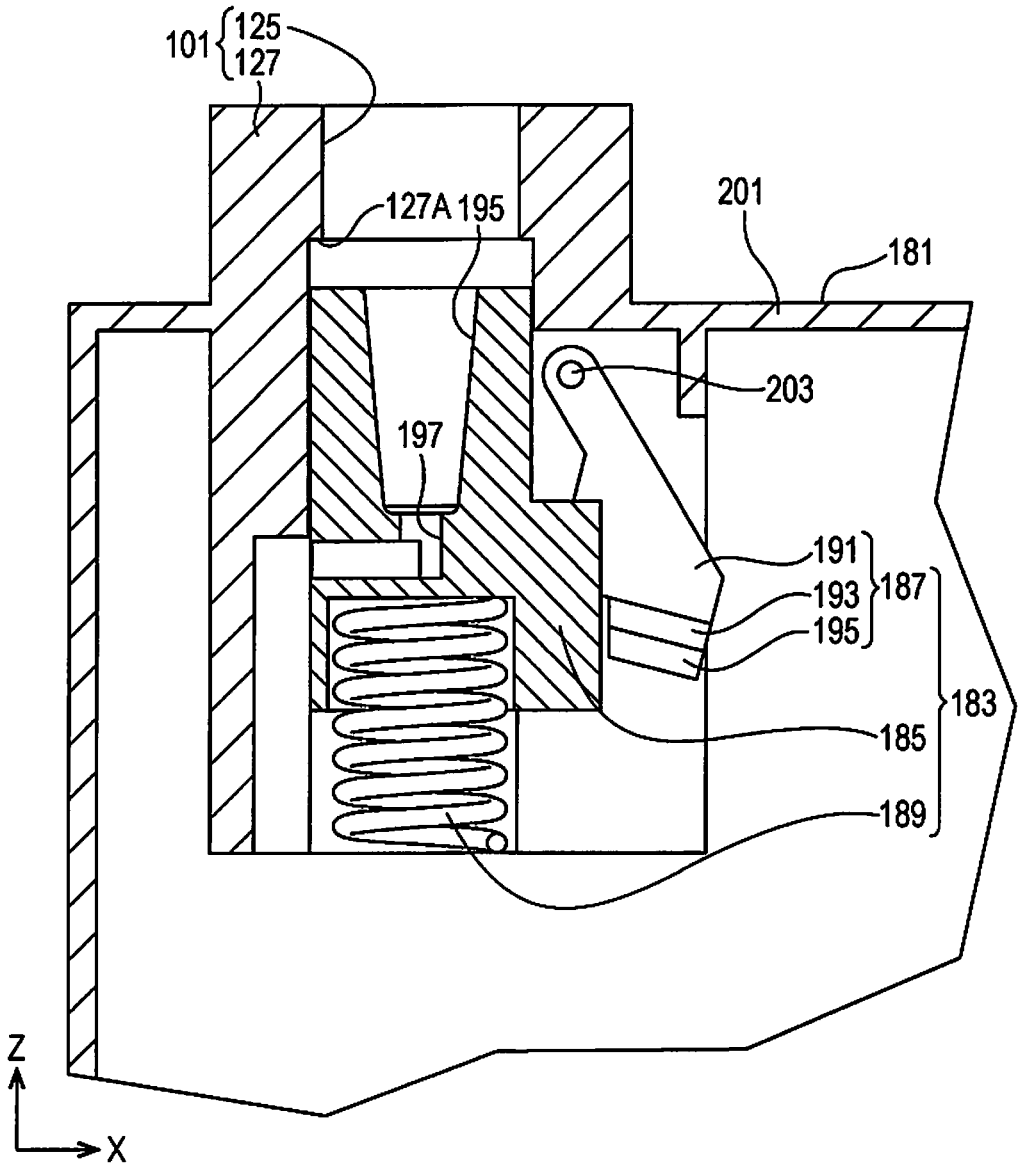
FIG. 23 is a sectional view illustrating the valve unit according to the fourth embodiment.

At that time, as illustrated in FIG. 23, the valve member 185 receives a press force which resists the bias force by the spring 189 and thereby shifts toward the spring 189 side. In this manner, the spring 189 is compressed. When the valve member 185 shifts toward the spring 189, the flow path 197 is joined to the flow path 217. The flow path 217 is provided on the inner circumference of the side wall 127 and has a concave groove shape from the inner circumferential surface of the side wall 127 toward the outer circumferential surface thereof. When the flow path 197 is joined to the flow path 217, the engagement section 207 of the lever main body 191 engages with the engagement target section 205. In this manner, the position of the valve member 185 is fixed. A state in which the engagement section 207 of the lever main body 191 engages with the engagement target section 205 and the flow path 197 is joined to the flow path 217 is referred to as the opened state.

Figure 24:
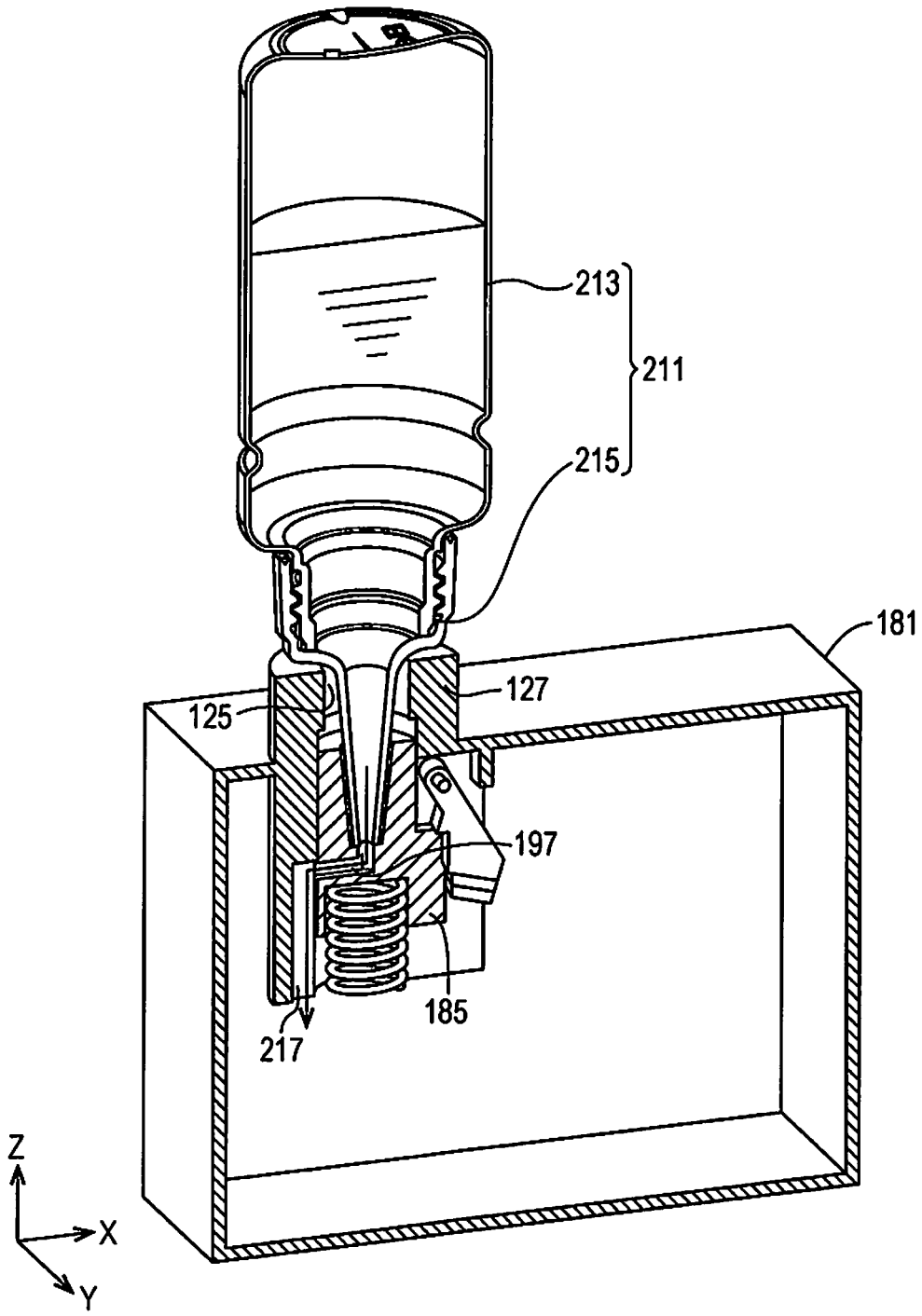
FIG. 24 is a sectional view illustrating the valve unit and the filling bottle according to the fourth embodiment.
Figure 25:
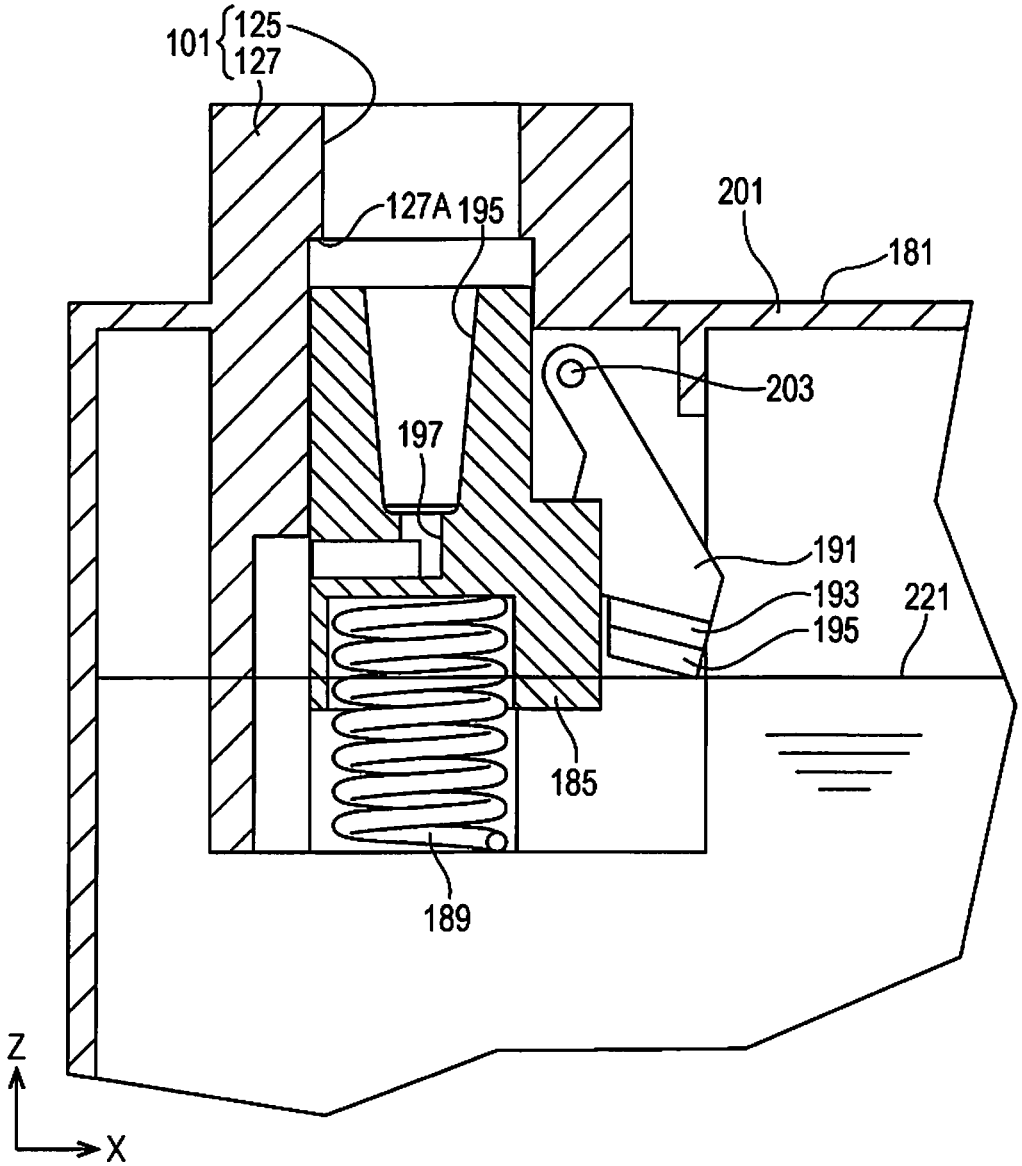
FIG. 25 is a sectional view illustrating the valve unit according to the fourth embodiment.

At the time of the opened state, the operator grips the filling bottle 211 and fills the case 181 with the ink in the bottle main body 213 through the nozzle 215. At that time, as illustrated in FIG. 24, the case 181 is filled with the ink in the bottle main body 213 through the flow path 197 and the flow path 217 from the nozzle 215. When the case 181 is filled with the ink in the bottle main body 213, as illustrated in FIG. 25, the liquid surface 221 of the ink reaches the float 194. When the liquid surface 221 of the ink reaches the float 194, buoyancy acts on the float 194 due to the ink. When the buoyancy acts on the float 194, a rotational force (torque) acts in a direction in which the weight unit 193 is separated away from the valve member 185 around the shaft 203, that is, in a direction in which the engagement target section 205 is unlocked by the engagement section 207, in the lever main body 191. When the buoyancy which acts on the float 194 exceeds a predetermined level, the engagement target section 205 is unlocked by the engagement section 207. In this manner, the closed state is performed.

In other words, when the nozzle 215 of the filling bottle 211 is inserted into the ink filling unit 101, a communication path from the ink filling unit 101 to the inside of the case 181 is opened in the valve unit 183. In this state, since the valve member 185 is locked by the locking lever 187, the opened state of the communication path is maintained. In the opened state of the communication path, it is possible to fill the case 181 with the ink from the ink filling unit 101 through the nozzle 215. When the case 181 is filled with the ink above the predetermined level, the valve member 185 is unlocked by the locking lever 187 and thus, the communication path is closed. In this manner, it is easy to avoid spilling out of the ink from the ink filling unit 101.

In addition, in the valve unit 183, when the valve member 185 is pressed with a press force in a direction opposite to the bias force of the spring 189, with a nozzle 215, the communication path from the ink filling unit 101 to the inside of the case 181 is opened and the valve member 185 is locked by the locking lever 187. When the valve member 185 is unlocked by the locking lever 187, the bias force of the spring 189 acts also on the nozzle 215 through the valve member 185. In this manner, it is possible to notify that the case 181 is filled with the ink above the predetermined level.

According to the embodiments described above, the liquid discharge apparatus may use a liquid other than ink by ejecting, discharging, or applying. States of the liquid discharged from the liquid discharge apparatus as a droplet having a fine amount includes a granular state, a droplet state, and a thread state with a tail. Here, the liquid may be a material which can be used in the liquid discharge apparatus. For example, a liquid phase substance may be used and examples of the liquid include a liquid body having high or low viscosity, sol, gel water, or another fluid body such as an inorganic solvent, an organic solvent, a solution, a liquid resin, or a liquid metal (metal melt). In addition, examples include not only a liquid as one state of a substance, but also include a substance obtained by dissolving, dispersing, or mixing of particles of a functional material formed of a solid material such as a pigment or metal particles in a solvent. A representative example of a liquid includes ink described in the embodiments above, liquid crystal, or the like. Here, ink includes various liquid compositions such as common water-based ink, oil-based ink, gel ink, or hot melt ink. A specific example of the liquid discharge apparatus includes a liquid discharge apparatus which ejects a liquid containing a material such as an electrode material or a color material in a state of being dispersed or dissolved, which is used in manufacturing or the like of a liquid crystal display, an electroluminescence (EL) display, a field emission display, or a color filter. In addition, examples of the liquid discharge apparatus may include a liquid discharge apparatus which ejects a bioorganic material used in manufacturing a bio chip, a liquid discharge apparatus which is used as an accurate pipette and ejects a liquid as a sample, a printing machine, a microdispenser, or the like. Further, the liquid discharge apparatus may eject lubricant oil by pinpoint to a precision machine such as a watch or a camera, or the liquid discharge apparatus may eject a transparent resin solution such as an ultraviolet curing resin onto a substrate so as to form a micro-hemispherical lens (optical lens) used in an optical communication element. In addition, the liquid discharge apparatus may eject an etching solution such as acid or alkali so as to etch a substrate or the like.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only a selected embodiment has been chosen to illustrate the present invention, it will be apparent to those skilled in the art from this disclosure that various changes and modifications can be made herein without departing from the scope of the invention as defined in the appended claims. Furthermore, the foregoing descriptions of the embodiment according to the present invention are provided for illustration only, and not for the purpose of limiting the invention as defined by the appended claims and their equivalents.

What is claimed is:

1. An ink tank comprising:

a tank main body that is able to contain ink;

an ink filling unit that is provided in the tank main body and has an opening which enables the tank main body to be filled with the ink;

a first ink chamber that is provided in the tank main body and communicates with the ink filling unit;

a recessed section provided on a peripheral section of the ink filling unit in the tank main body; and a second ink chamber that is provided in the tank main body, communicates with the recessed section, and communicates with the first ink chamber at a position different from that of the ink filling unit.

2. The ink tank according to claim 1, wherein the second ink chamber has an inclined surface which is inclined to be lowered from a communication portion side with the recessed section toward a communication portion side with the first ink chamber in a state in which the opening is directed vertically upward.

3. The ink tank according to claim 1, wherein, of a wall which partitions the second ink chamber, at least a part of the wall, which faces the outside of the tank main body, is optically transparent.

4. The ink tank according to claim 1, wherein a flow resistance in a communication portion between the second ink chamber and the first ink chamber is greater than a flow resistance in the ink filling unit.

5. The ink tank according to claim 1, wherein the second ink chamber communicates with the recessed section through a gap.

6. The ink tank according to claim 1, wherein the recessed section is formed on an outer surface of the tank main body.

7. The ink tank according to claim 1, wherein the recessed section has a wall which extends vertically.

8. The ink tank according to claim 7, wherein the wall of the recessed section extends in a same direction as the ink filling unit extends.

* * * * *